United States Patent [19]

Iwamoto et al.

[11] Patent Number: 4,972,235

[45] Date of Patent: Nov. 20, 1990

[54] COPIER WITH AN AUTOMATIC DOCUMENT FEEDER

[75] Inventors: Minoru Iwamoto, Yokohama; Kenji Kojima; Yukitaka Nakazato, both of Tokyo, all of Japan

[73] Assignee: Ricoh Company, Ltd., Tokyo, Japan

[21] Appl. No.: 299,431

[22] Filed: Jan. 23, 1989

[30] Foreign Application Priority Data

| | | | |
|---|---|---|---|
| Jan. 22, 1988 | [JP] | Japan | 63-13164 |
| Feb. 29, 1988 | [JP] | Japan | 63-46339 |
| Oct. 21, 1988 | [JP] | Japan | 63-263863 |

[51] Int. Cl.[5] ..... G03G 15/00

[52] U.S. Cl. ..... 355/311

[58] Field of Search ..... 355/311; 271/227

[56] References Cited

U.S. PATENT DOCUMENTS

| | | | |
|---|---|---|---|
| 4,440,487 | 4/1984 | Miura | 355/3 SH X |
| 4,455,018 | 6/1984 | Colglazier et al. | 271/227 |
| 4,610,533 | 9/1986 | Takahato | 271/265 X |
| 4,814,831 | 3/1989 | Iwamoto | 355/40 |

FOREIGN PATENT DOCUMENTS

| | | | |
|---|---|---|---|
| 125763 | 10/1981 | Japan | 355/14 R |
| 86860 | 5/1982 | Japan | 355/8 |
| 42559 | 3/1984 | Japan | 355/14 SH |

*Primary Examiner*—Donald A. Griffin

*Attorney, Agent, or Firm*—Oblon, Spivak, McClelland, Maier & Neustadt

[57] ABSTRACT

A copier with an automatic document feeder (ADF) which causes the ADF to automatically feed a document to a predetermined position on a glass platen and causes optics in the form of a scanner for exposure to move for illuminating the document on the glass platen. The copier changes a document stop position on a glass platen and a home position of the scanner depending upon size of a document to be fed by the ADF or the size of paper sheets for reproducing the document thereon.

16 Claims, 22 Drawing Sheets

| FIG. 22A |
| --- |
| FIG. 22B |

COPIER WITH AN AUTOMATIC DOCUMENT FEEDER

BACKGROUND OF THE INVENTION

The present invention relates to a copier of the type automatically transporting an original document to and stopping it at a predetermined position on a glass platen by an automatic document feeder (ADF) and then moving optics for exposure in the form of a scanner to illuminate the document. More particularly, the present invention is concerned with a copier of the type described which is operable at an extremely high copying speed.

Generally, a copier having optics in the form of a scanner and an ADF is provided with a glass platen the size of which is large enough to allow at least a document of size or format A3 to be laid laterally long with respect to an intended direction of document feed. This type of copier is in many cases constructed such that documents and paper sheets are fed from the right to the left as viewed from the front of the copier and, in the event of exposure, the scanner is transported from the left to the right, for the purpose of facilitating manual operations. For this reason, it is a common practice with such a copier to stop and position a document on the glass platen by using the left edge of the glass platen for a reference. The scanner is usually located at a home position which is slightly leftward of the left edge of the glass platen, i.e., reference position and, at the instant of exposure, it is moved to the right away from the home position to scan the document which is held in the reference position on the glass platen.

A problem with the prior art copier with an ADF described above is that a document has to be fed rightward until its leading edge reachs the reference position defined at the left end of the glass platen, with no regard to the size of the document. More specifically, the same period of time is needed for a document of comparatively small size (e.g. format A4) to be located at the reference position as needed for a document of comparatively largest size usable with the copier. Hence, the copying rate is far lower when different documents are sequentially fed in a continuous copy mode than when the same document is reproduced in a repeat copy mode, whatever the size of the documents may be.

To eliminate the above problem, an arrangement may be made such that the size of documents to be automatically fed from a document tray is sensed beforehand and the stop position (sheet-through mode) or the home position (optics transport mode) of the optics is changed in matching relation to the sensed document size, as disclosed in U.S. patent application Ser. No. 07/199,869 entitled "AUTOMATIC DOCUMENT FEEDER" by way of example. Although this kind of implementation is successful in increasing the copying rate to a substantial extent by changing the position of the optics, a document is still fed to a predetermined reference position on the glass platen with no regard to its size and, therefore, the copying rate cannot be increased beyond a certain limit.

SUMMARY OF THE INVENTION

It is therefore an object of the present invention to provide a copier with an ADF operable with a higher copying rate than the prior art by noticeably reducing the period of time necessary for the ADF to locate a document of comparatively small size at a predetermined position on a glass platen as well as the period of time necessary for optics to scan the document held at the predetermined position.

It is another object of the present invention to provide a generally improved copier with an ADF.

A copier equipped with an ADF which causes the ADF to automatically transport a document to a glass platen and stop the document in a predetermined stop position on the glass platen and causes movable optics for exposure to illuminate an image carrying surface of the document of the present invention comprises size sensing means for sensing a size of at least one of a document to be transported by the ADF and a paper sheet on which the document is to be reproduced, position setting means for setting the stop position on the glass platen on the basis of the size sensed by the sensing means, and home position changing means for changing a home position of the optics on the basis of the size sensed by the sensing means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
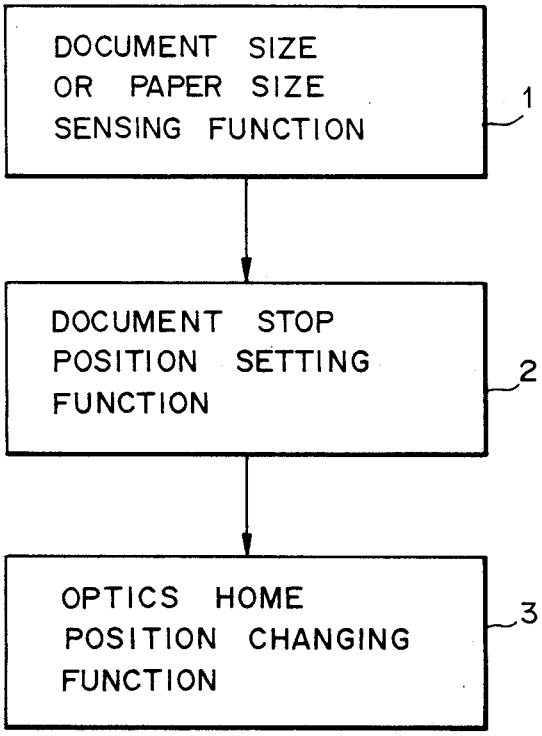
FIG. 1 is a schematic block diagram useful for understanding the principle of the present invention.

Referring to FIG. 1 of the drawings, the principle of the present invention is shown in a schematic block diagram. As shown, the present invention is basically implemented by a function 1 of sensing the size of a document or that of a paper sheet, a function 2 of defining a stop position of a document on a glass platen, and a function 3 of changing the home position of optics. Specifically, the principal operations are sensing the size, as measured in an intended direction of document feed, of a document to be fed to and stopped on a glass platen of a copier by an ADF or of a paper sheet selected for reproducing the document thereon, setting a document stop position on the glass platen based on the sensed size, and changing the home position of optics in the form of a scanner in matching relation to the set document stop position.

Figure 2:
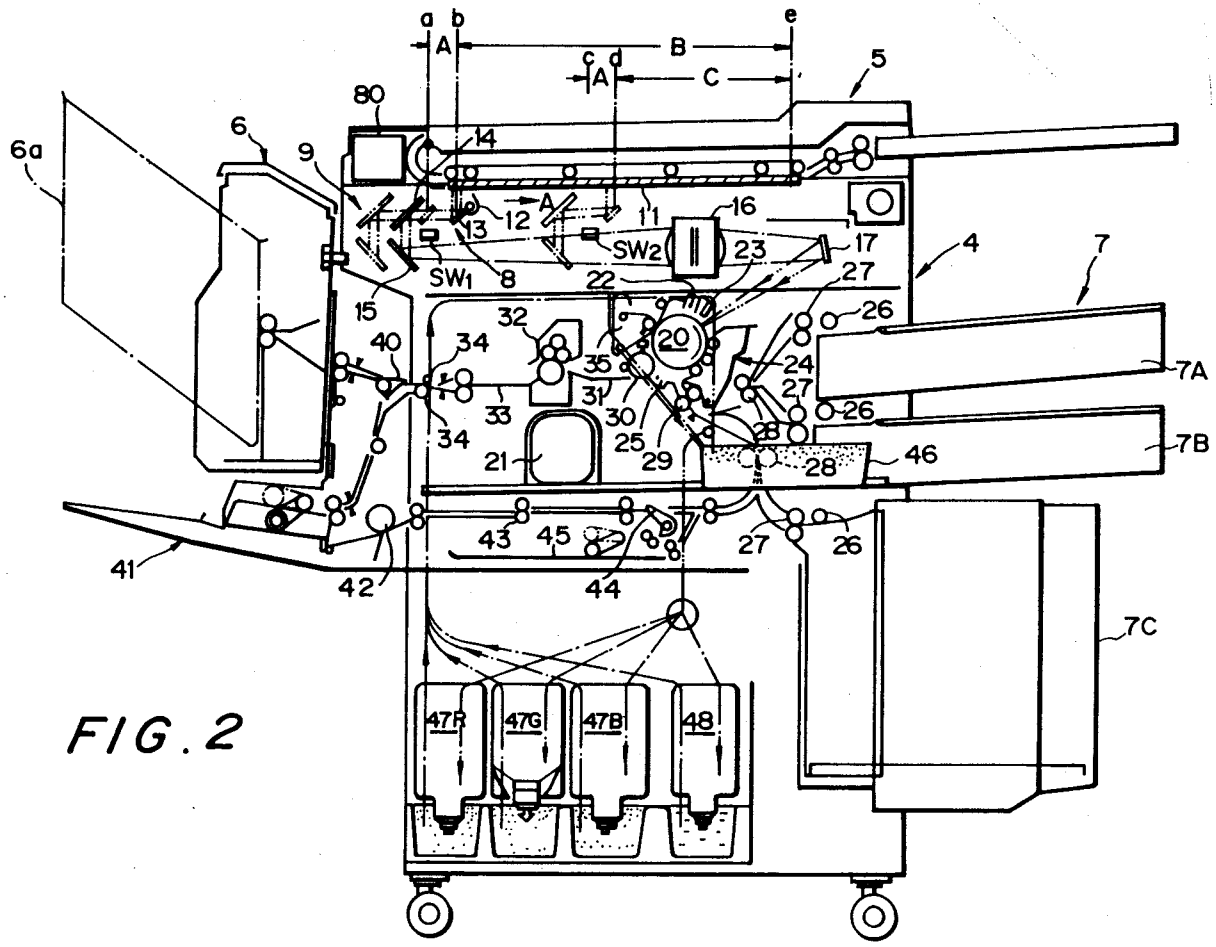
FIG. 2 shows the general construction of mechanical sections included in one embodiment of a copier with an ADF in accordance with the present invention.

FIG. 2 shows a copier with an ADF embodying the present invention. In the figure, an ADF 5 is mounted on a body 4 of the copier while a sorter 6 is mounted on one side or copy outlet side of the copier body 4. Arranged on the other side or sheet inlet side of the copier body 4 is a sheet feed section 7 adapted to selectively feed paper sheets from two paper cassettes 7A and 7B which are arranged one above the other and a mass paper feed tray 7C. Each of the cassettes 7A and 7B and tray 7C is loaded with a stack of paper sheets of a different size. As the ADF 5 feeds a document and sets it on a glass platen 11 of the copier body 4, a lamp 12 illuminates the document. An imagewise reflection from the document is focused onto the surface of a photoconductive drum 20 by a first mirror 13, a second mirror 14, a third mirror 15, a lens unit 16, and a fourth mirror 17. The drum 20 is driven in a rotary motion in a direction indicated by an arrow in the figure by a main motor 21 via a gearing (not shown). A first scanner 8 including the lamp 12 and first mirror 13 is mounted on a first carriage (not shown) and movable at a predetermined speed as indicated by an arrow A. A second scanner 9 including the second and third mirrors 14 and 15, respectively, is mounted on a second carriage (not shown) and driven at one half the speed of the first carriage in the direction A.

The first scanner 8 is capable of illuminating the entire surface of the glass platen 11 by moving at a constant speed from a reference side b of the glass platen to the opposite side e in parallel with the surface of the glass platen 11. Assume that the maximum document size with which the copier is operable is format A3. Then, the first scanner 8 is moved over a different illuminating range for each document size, i.e., a first home position of the first scanner 8 is defined by a position a which is a first document leading edge stop position b plus an approach distance A for documents of format A4 (laterally long with respect to the direction of document feed) to A3 while a second home position is defined by a position c which is a second document leading edge stop position d plus the approach distance A for documents of formats smaller than A4. The velocity of the first scanner 8 is controlled to equal the quotient produced by dividing the peripheral speed of the drum 20 by a desired magnifying power. Upon the completion of illumination, the scanner 8 is returned to the first home position a at a high speed. More specifically, the scanner 8 is held at the first home position a whenever the copier is not operated.

Home position switches SW1 and SW2 are located at the first and second home positions a and c, respectively. When the first scanner 8 is returned to the first or second home position depending upon the size of a document, the position switch SW1 or SW2 is actuated to stop the drive of the scanner 8. Interlocked with the first scanner 8, the second scanner 9 is stopped and started at either one of the first and second home positions. The scanner, therefore, starts moving in the direction A at the first home position a for a document of format larger than A4 and at the second position c for a document of format smaller than A4.

The surface of the drum 20 is uniformly charged by a main charger 22. After the charged surface of the drum 20 has moved away from a fractioned erasing unit 23, it is exposed imagewise by optics which includes the scanner with the result that a latent image is formed electrostatically on the drum surface. The latent image is developed by a liquid developer at a wet-process developing device 24, and the resulting visible image is transported to a transfer charger 25. A paper sheet fed from any of the paper cassettes 7A and 7B and mass paper tray 7C by a feed roller 26 is driven by a roller pair 27 and 28 to a register roller pair 29. The register roller pair 29 feeds the paper sheet at an adequate timing along a paper guide to that surface portion of the drum 20 which faces the transfer charger 25, whereby the visible image is transferred from the drum 20 to the paper sheet. The paper sheet carrying the visible image thereon is separated from the drum 20 by a separator unit 30 and then guided by a paper guide 31 into a fixing unit 32. After the visible image has been fixed on the paper sheet by heat which is radiated by a heating element (not shown) of a fixing roller, the paper sheet is driven out of the copier body 4 by a discharge roller pair 34. Such paper sheets or copies are sequentially distributed to, among a number of bins **6*a* of the sorter 6**, particular bins selected beforehand.

In a combination copy mode or a two-side copy mode which is well known in the art, a paper sheet carrying an image on one side thereof is directed downward by a selector 40 and temporarily stacked on an intermediate tray 41 to wait for refeed. Then, the paper sheet is re-fed from the intermediate tray 41 to the transfer charger 25 by rollers such as a roller 42 and a roller pair 43 along a second transport path. In a two-side copy mode, since the paper sheet fed from the intermediate tray 41 to the transfer charger 25 is positioned face down, it can be provided with another visible image as it is. On the other hand, in a combination copy mode such as an undercolor mode for reproducing an image on a single color, the selector 44 is actuated to turn over the paper sheet at a second turnout position 45 and, then, the paper sheet is transported to the transfer charger 25 to be provided with another image on the same side as the first image.

After the image transfer effected as stated above, the surface of the drum 20 is cleaned by a cleaning unit 35 to prepare for another copying cycle.

A reservoir 46 storing a black developer is located at the right-hand side of an intermediate portion of the copier body 1. Located in a lower portion of the copier body 1 are reservoirs 47R, 47G and 47B storing red, green and blue developers, respectively, and a reservoir 48 storing a cleaning agent. The reservoirs 47, 47R, 47G, 47B and 48 are each communicated to the developing device 24 and cleaning unit 35 by independent pipings, recirculating their associated liquids. Feelers are individually associated with the paper cassettes 7A and 7B and mass paper tray 7C to sense the sizes of paper sheets (inclusive of longitudinal/lateral position information) loaded in the cassettes and tray. When the paper feed section 7 is mounted on the copier body 4, output signals of the feelers are fed to a control section which is built in the copier body 4. Sheet selection switches are arranged on an operation board (not shown) and accessible for selecting any of the paper cassettes 7A and 7B and mass paper tray 7C. The control section, therefore, is capable of indentifying the size of paper sheets to be fed on the basis of an output signal of any of the sheet selection switches and outputs of the feelers which are individually associated with the paper cassettes 7A and 7B and mass paper tray 7C.

Figure 3:
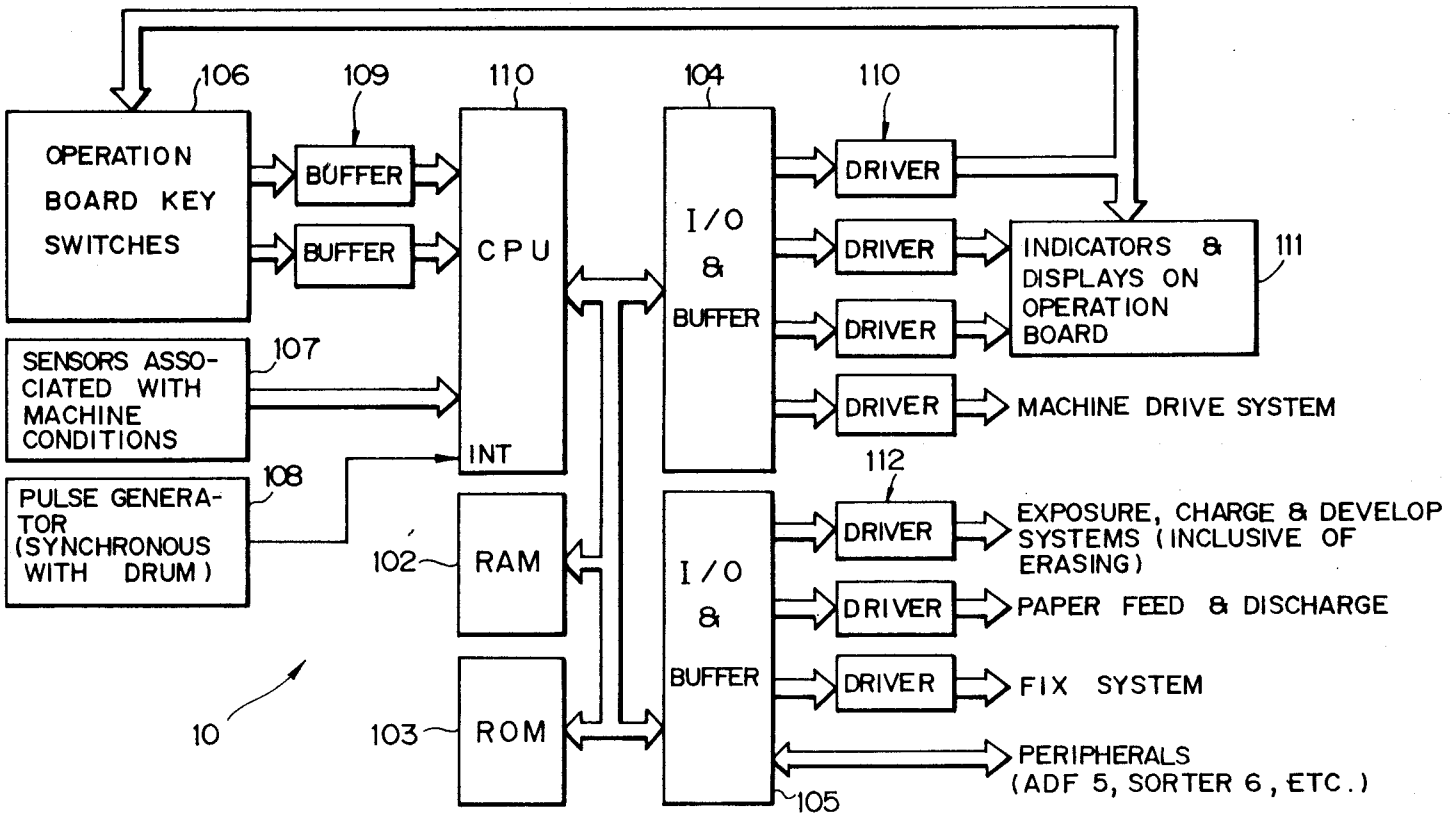
FIG. 3 is a block diagram schematically showing a control section installed in a body of the copier of FIG. 2.

Referring to FIG. 3, the control section installed in the copier body 4 for controlling the entire copier is shown. The control section, generally 10, is implemented as a microcomputer which includes a central processing unit (CPU) 101 and a random access memory (RAM) 102, a read only memory (ROM) 103, and an input/output (I/O) ports and buffers 104 and 105 which are interconnected to the CPU 101 by an address bus, control bus and data bus. Signals from a group of key switches 106 which are arranged on the operation board are applied to the CPU 101 via buffers 109. Also applied to the CPU 101 are the outputs of various kinds of sensors 107 each being responsive to a different condition of the machine and the output of a pulse generator 108 which generates pulses in synchronism with the rotations of the drum 20. The I/O port and buffer 104 delivers control signals to various indicators and displays 111 on the operation board and to machine driving systems via independent drivers 110. The other I/O port and buffer 105 feeds control signals to various loads installed in the copier body 4 via independent drivers 112 while interchanging signals with the ADF 5, sorter 6 and other peripheral equipment. The key switches 106 and the indicators and displays 111 on the operation board may directly interchange signals with each other as needed.

The control section 10 having the above construction processes key inputs on the operation board, controls the indicators and displays, executes a sequence control inclusive of the peripheral equipment during copying operations, determines various kinds of failures, and performs other various kinds of controls.

Figure 4:
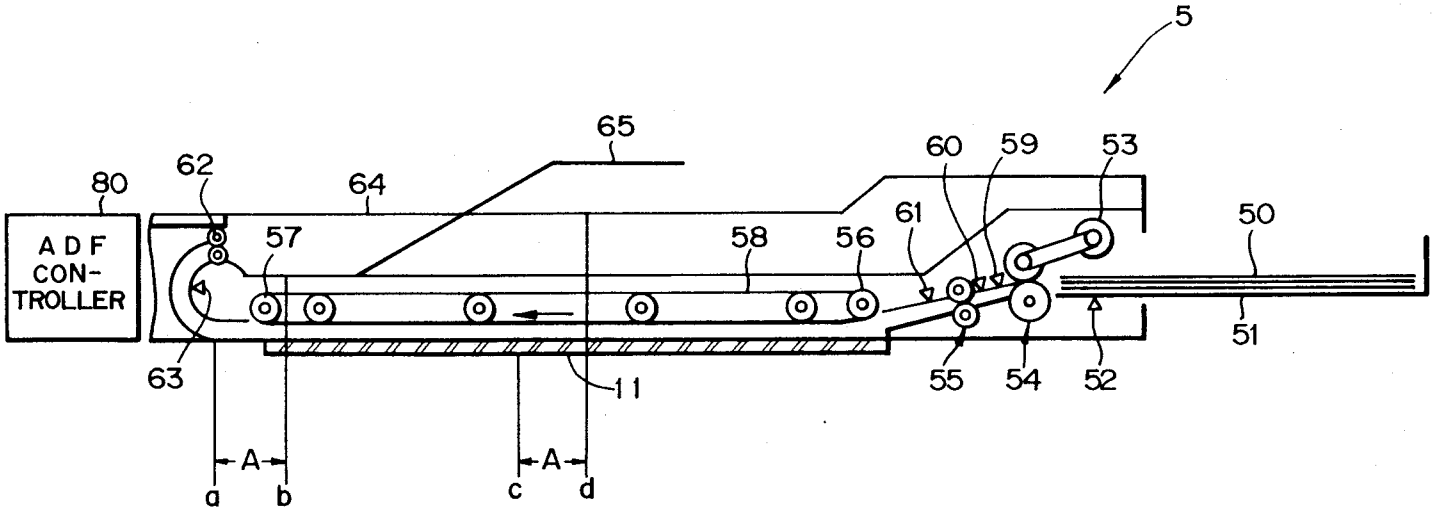
FIG. 4 shows a specific construction of the ADF shown in FIG. 2.
Figure 5:
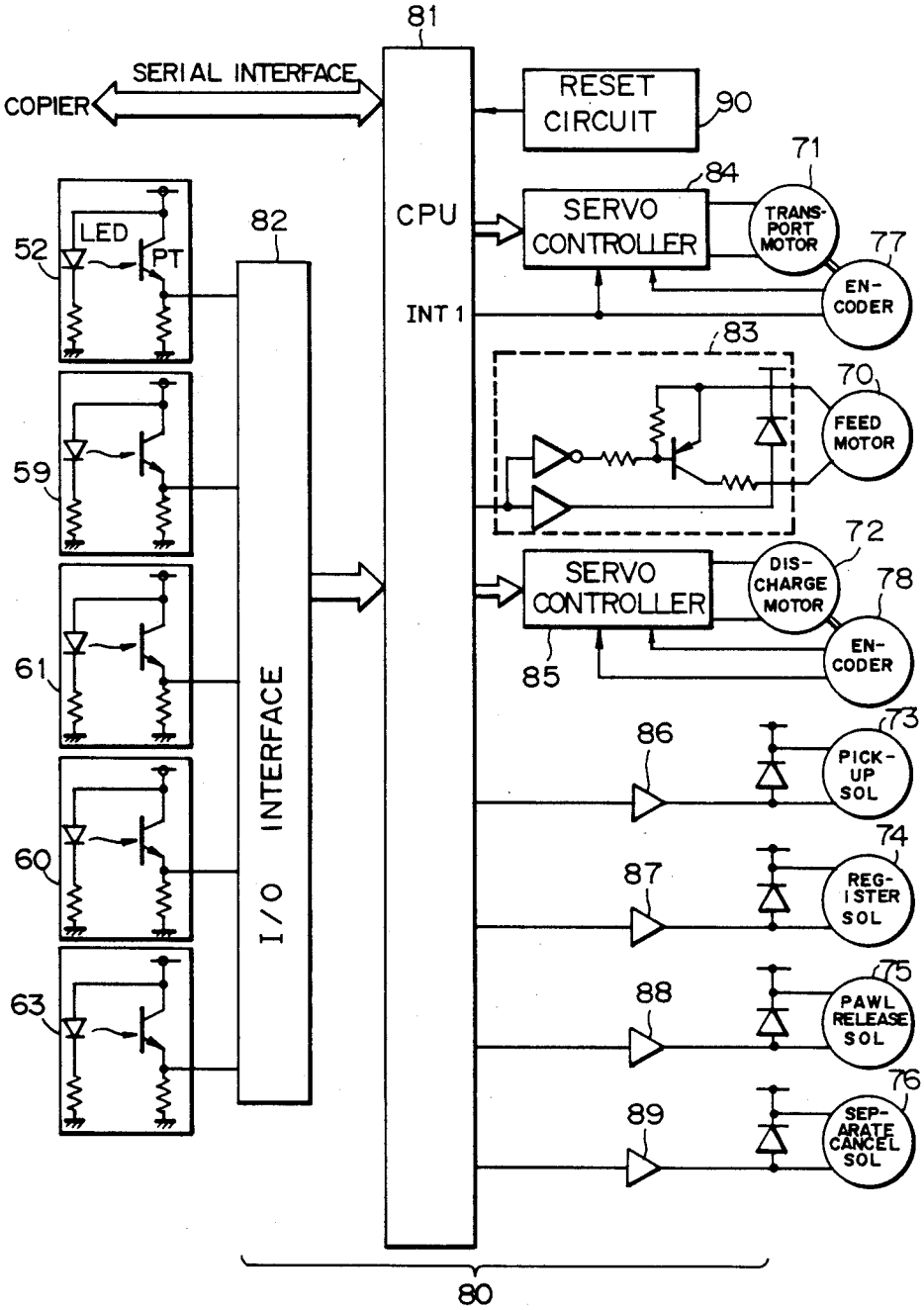
FIG. 5 is a schematic block diagram of a control system built in the ADF of FIG. 4.

FIGS. 4 and 5 show respectively the construction of the ADF 5 and the construction of a control system built in the ADF 5. The ADF mode operation of the copier of this embodiment will be described with reference to these figures.

As shown in FIG. 4, the ADF 5 includes a document feed section which is made up of a subsection having a document table 51, a pick-up roller 53, and a separator roller pair 54, and a set sensor 52 responsive to setting of a document on the glass platen 11, a lead edge sensor 59 responsive to the leading edge of a document, a size sensor 60 responsive to the size of a document, and a register sensor 61. The document table 51 is loaded with a stack of documents 50. The ADF 51 further includes a transport section having a pull-out roller pair 55 and a belt 58 which is passed over a drive roller 56 and a driven roller 57, and a document discharge section having a discharge roller pair 62, a discharge sensor 63, and a receive tray 65 mounted on a discharge cover 64 for receiving discharged documents. Although not shown in FIG. 4, there are also provided in the ADF 5 a feed motor 70, a transport motor 71, a discharge motor 72, a pick-up solenoid (SOL) 73, a register SOL 74, a pawl release SOL 75, a separation cancel SOL 76 which are shown in FIG. 5, etc. As shown in FIGS. 2 and 4, an ADF controller 80 is built in a left end portion of the ADF 5 for controlling the operations of the entire ADF 5. Details of the ADF controller 80 will be described with reference to FIG. 5 later.

The documents 50 are stacked on the document tray 51 face down. As the set sensor 52 senses the documents 50 and a start button provided on the operation board of the copier body 4 is pressed, the pick-up SOL 73 is energized to lower the pick-up roller 53 into contact with the uppermost document 50 of the stack. At the same time, the pawl release SOL 75 is energized to release a pawl stop adapted to inhibit the feed of documents, thereby preparing the ADF 5 for the fed of documents. Upon the lapse of a short period of time, the feed motor 70 is turned on to drive the pick-up roller 53 and separator roller pair 54 clockwise. While the pick-up roller 53 feeds the uppermost document 50, the separator roller pair 54 serves to separate the uppermost document 50 from the others by friction and thereby prevents double feed. As the lead edge sensor 59 senses the leading edge of the document 50, the pick-up SOL 73 is turned off so that the pick-up roller 53 is raised to regain its reference position and, at the same time, the feed motor 70 is deenergized to stop the rotation of the pick-up roller 53 and separator roller pair 54. Further, only when the lead edge sensor 59 has an ON state, the separation cancel SOL 76 is energized to cancel the gap of the separator roller pair 54 to thereby safeguard the document 50 against smearing.

As the lead edge sensor 59 senses the lead edge of the document 50 as stated above, the transport motor 71 is energized to drive the belt 58 and, at the same time, the register SOL 74 is energized to drive the pull-out roller 55 via a register clutch. Consequently, the document 50 is transferred from the pull-out roller 55 to the transport belt 58. At this instant, the period of time needed for the document 50 to move away from the register roller 61 is determined in terms of the number of pulses appeared from the instant when the register sensor 61 sensed the leading edge of the document 50 to the instant when the sensor 61 sensed the trailing edge of the same. The number of pulses counted is transmitted to the copier body 4 to serve as size data, as measured in the intended direction of transport, which is used to stop the document 50 at a predetermined position on the glass platen 11. Such document size data will be indispensable when the copier is operated in a uniform size mode for copying documents of different sizes by automatically enlarging or reducing them on the basis of a designated paper size, or in an automatic paper selection mode for, when any of the paper cassettes 7A and 7B and mass paper tray 7C is loaded with paper sheets of particular size which matches a magnifying power selected on the basis of the document size, automatically selecting those paper sheets and copying the document on them.

The register sensor 61 responsive to the length of a document 50 as measured in the direction of feed does not suffice because a document of format A4 fed in laterally long position and a document of format A5 fed in a longitudinally long position are the same with respect to the length in the direction of feed and therefore cannot be accurately discriminated from each other. To promote accurate distinction, the size sensor 60 senses the dimension of a document as measured in a direction perpendicular to the direction of feed and transmits the resulting size data to the copier body 4.

As soon as the trailing edge of the document 50 moves away from the register sensor 61, the register SOL 74 is deenergized to uncouple the register clutch and thereby stops the rotation of the pull-out roller pair 55. The belt 58 to which the document 50 is transferred from the pull-out roller pair 55 transports the document 50 onto the glass platen 11 of the copier body 4. Concerning the first document 50, the belt 58 is deactivated unconditionally as soon as the leading edge of the document 50 reaches the first stop position b shown in FIGS. 2 and 4. As for the second document 50 and onward, the belt 58 is deactivated at a particular timing in response to output data of the ADF 5 representative of a particular size as measured in the direction of feed, i.e., the transport of the document 50 is interrupted when the leading edge of the document 50 reaches the first stop position b or the second stop position d depending the above-mentioned size of the document 50. More specifically, the transport is interrupted as the document 50 reaches the first stop position b if the document 50 is of any of formats A4 to A3 and as the document 50 reaches the second stop position d if it is of format smaller than A4.

The home position of the first scanner 8 is changed to the first position a or the second position c in association with the document stop position b or d, the illuminating operation beginning there. More specifically, for the first document, the first scanner 8 starts illuminating it at the first home position or standby position a. For the second document and the successive documents, the scanner 8 starts illuminating them at either the first home position a (for documents of formats A4 to A3) or the second home position c (for documents of format smaller than A4) depending upon the size of a document as measured in the direction of feed. Hence, the scanner 8 being returned after illuminating the first document is brought to a stop at the first home position a or the second home position c depending upon the size of each of the second document and onward. Upon completion of the illumination, the transport motor 71 and discharge motor 72 are turned on by a discharge signal fed thereto from the copier body 4 to drive the belt 58 and discharge roller pair 62, respectively. As a result, the document is discharged to the receive tray 65 by way of the discharge sensor 63. Simultaneously, the feed of the next document begins in response to the discharge signal from the copier body 4 and the output of the set sensor 52 representative of the presence of the documents 50. Such a sequence of steps is repeated until all of the documents 50 on the table 51 have been fed out.

As shown in FIG. 5, the ADF controller 80 shown in FIG. 2 includes a microcomputer or CPU 81 for controlling the motors 70 to 72 and solenoids 73 to 76 in response to the outputs of the sensors 52, 59, 60, 61 and 63 which are fed thereto via an I/O interface 82 and by interchanging signals with the control section of the copier body 4. The CPU 81 constitute the ADF controller 80 of FIG. 2 in cooperation with a drive circuit 83 associated with the feed motor 70, servo controllers 84 and 85 respectively associated with the transport motor 71 and discharge motor 72 for driving them at a constant speed, drivers 86 to 89 respectively associated with the solenoids 73 to 76, and a reset circuit 90. While each sensor is implemented by a photosensor consisting of a light emitting diode LED and a phototransistor PT, it may be implemented by a microswitch or similar sensor if desired.

The set sensor 52 determines whether or not the documents 50 are present on the table 51 and, if they are present, delivers its output representative of the presence to the I/O interface 82. The lead edge sensor 59 determines whether or not a document 50 has been fed and, by sensing the leading edge of the document 50, feeds a sense signal to the I/O interface 82. The register sensor 61 measures the length of a document 50 in the intended direction of feed and delivers a sense signal to the I/O interface 82 from the instant when it senses the leading edge of the document 50 to the instant when it senses the trailing edge of the same, i.e. until the document 50 is moved away from the sensor 61. In response, the CPU 81 determines the length of the document 50 in the direction of feed in terms of the duration of the sense output of the register sensor 61. The size sensor 60 is located in a particular position in the widthwise direction where it is capable of discriminating those documents which are the same with respect to the length in the direction of feed and different with respect to the width (e.g. a document of format A4 positioned laterally long and a document of format A5 positioned longitudinally long). In this respect, the size sensor 60 helps the register sensor 61 identify the size of a document and delivers its output to the I/O interface 82. Further, the discharge sensor 63 determines whether or not a document 50 has been discharged and, as the trailing edge of a document 50 is moved away from the sensor 63, it applies its sense signal to the I/O interface 82.

In response to the output signals of the various sensors stated above, the I/O interface 82 feeds them to the CPU 81 as needed. The reset circuit 90 functions to restore the various functions of the ADF 5 to original. For example, when a power source is turned on or in response to a command entered on the operation board of the copier body 4 or in response to a command from the CPU 81, the reset circuit 90 once restores the operation of the ADF 5 to original even when the feed of documents 50 is under way. The drive circuit 83 drives the feed motor 70 in response to a command from the CPU 81 which in turn appears in response to an ON signal from the set sensor 52, a copy start command from the copier body 4, etc. The servo controllers 84 and 85 are respectively adapted to drive the transport motor 71 and discharge motor 72 which are servo motors at a constant speed. More specifically, the servo controllers 84 and 85 drive respectively the motors 71 and 72 in response to data fed from the CPU 81 and then controls the rotation speeds of the motors 71 and 72 to commanded values in response to output pulses fed back from incremental rotary encoders 77 and 78, for example, which are directly connected to the motors 71 and 72, respectively.

Implemented as a general-purpose 16-bit or 32-bit microcomputer, the CPU 81 collectively controls the ADF 5 in response to the output signals of the various sensors fed from the I/O interface 82 and data and/or commands fed from the copier body 40 via a serial interface, such that the motors 70 to 72, pick-up SOL 73, register SOL 74, pawl release SOL 75, separation cancel SOL 76 and other loads are each driven at a predetermined timing. A control operation relating to the present invention is, among others, inputting output pulses of the encoder 77 associated with the transport motor 71 to an interrupt terminal INT1, starting counting the pulses when the register sensor 61 senses the leading edge of a document 50, and deenergizing the motor 71 when a predetermined count is reached to thereby stop the document 50 at a predetermined position on the glass platen 11. Further, the CPU 81 delivers various kinds of information associated with the ADF 5 to the copier body 4 via the serial interface so as to display the information on the operation board and/or to effect the sequential operations. Particularly, in response to the information from the CPU 81, the control section 10 installed in the copier body 4 as shown in FIG. 3 moves the first and second scanners 8 and 9 to any of the home positions a or c which are associated with the document stop positions b and d, respectively.

The control executed by the ADF controller 80 will be described with reference to FIGS. 6 to 21.

Figure 6:
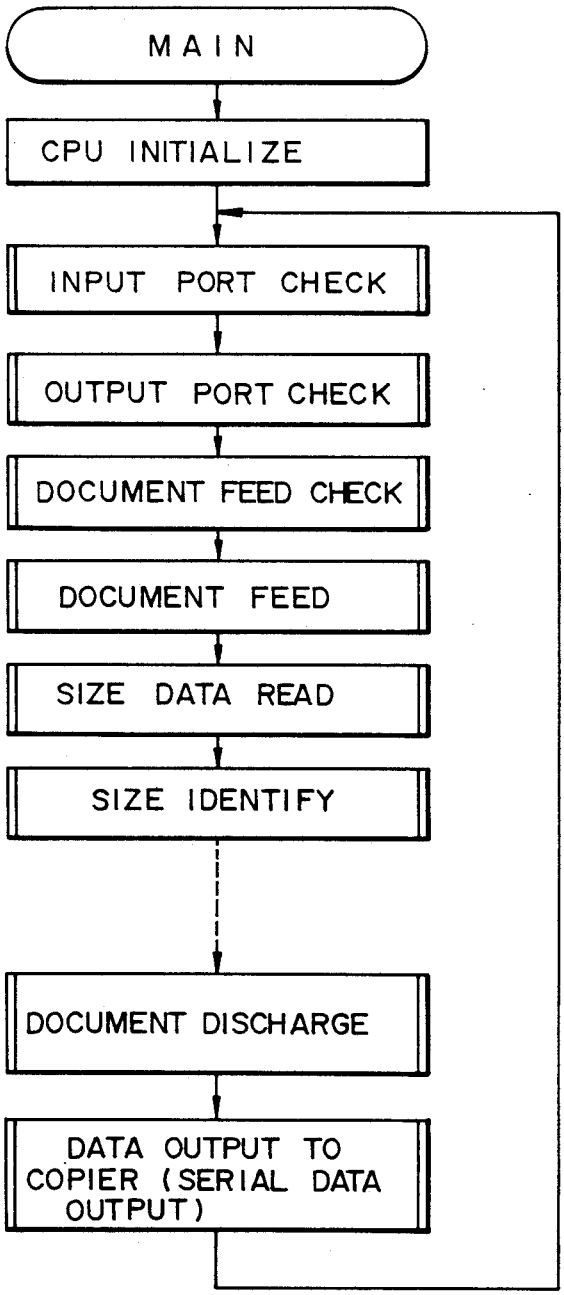
FIG. 6 is a flowchart demonstrating a specific control procedure which is assigned to an ADF controller of the control system shown in FIG. 5.

FIG. 6 is a flowchart showing a main routine representative of the entire sequential operations of the ADF controller 80. As shown, when the power source is turned on, the ADF controller 80 initializes the CPU 81 (CPU INITIALIZE) and then checks the states of the various sensors connected to the I/O interface 82, e.g. whether the set sensor 52 is in an ON state (INPUT PORT CHECK). Thereupon, the ADF controller 80 delivers an ON signal or an OFF signal to any of its output ports to which the motors and solenoids shown in FIG. 5 are connected (OUTPUT PORT OUT). This is followed by consecutive subroutines which are labeled DOCUMENT FEED CHECK and DOCUMENT FEED, respectively. Then, size data is read and identified (SIZE IDENTIFY). As the illumination in the copier body 4 completes, the ADF controller 80 discharges the document 50 (DOCUMENT DISCHARGE) and, finally, transmits to the control section of the copier body 4 data indicative of the document stop position for the second document and the successive documents as well as other data (DATA OUTPUT TO COPIER). Thereupon, the program returns to the INPUT PORT CHECK subroutine.

Figure 7:
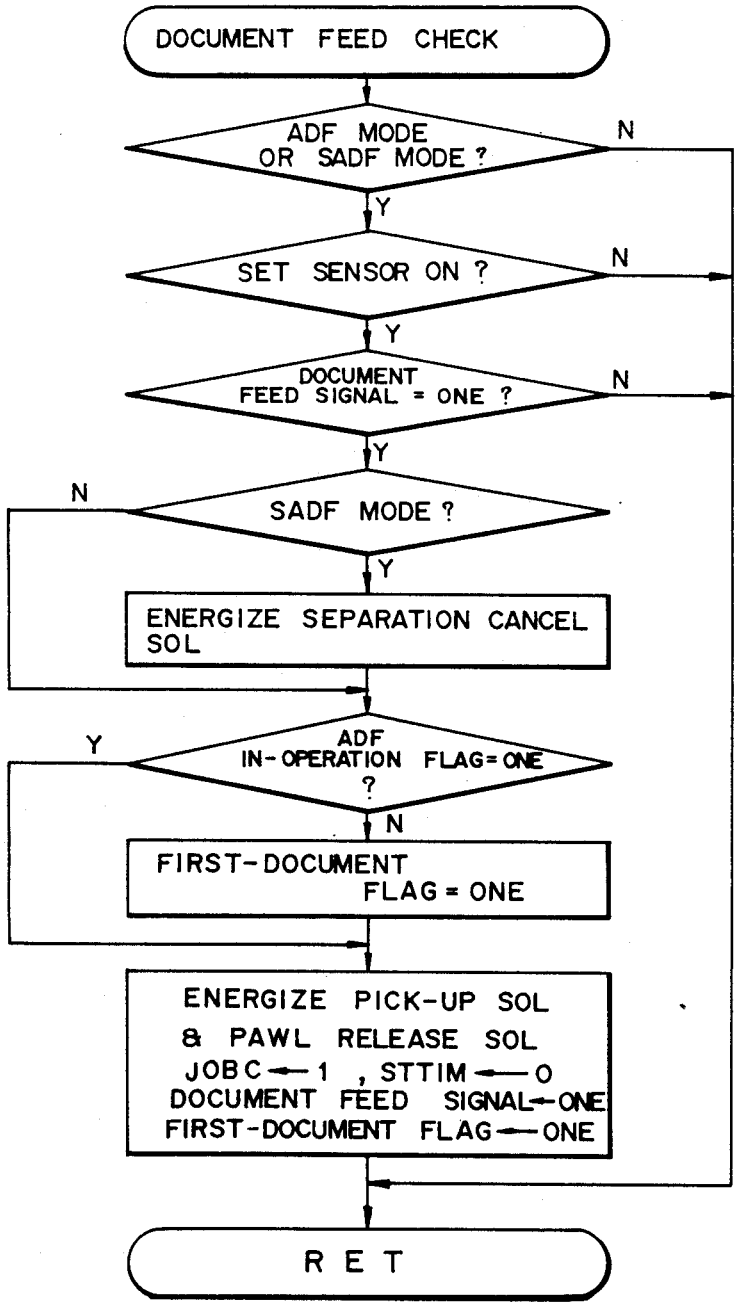
FIG. 7 is a flowchart showing a document feed check subroutine forming a part of the main routine of FIG. 6.

FIG. 7 shows the DOCUMENT FEED CHECK subroutine of FIG. 6 in detail. This subroutine begins with determining whether any of an ADF mode and a semi-ADF (SADF) mode has been selected. If the answer is YES, the ADF controller 80 determines whether documents 50 are present on the document table 51 of FIG. 4 by referencing the ON/OFF state of the set sensor 52. If the set sensor 52 is in an ON state, the controller 80 sees if the document feed signal from the copier body 4 is a (logical) ONE and, if it is a ONE, determines whether the SADF mode has been selected. If the SADF mode has been selected, the controller 80 energizes the separation cancel SOL. Then, the controller 80 determines whether an ADF in-operation flag is a ONE. If the SADF mode has not been selected, the controller 80 directly sees if the next ADF in-operation flag is a ONE. If the ADF in-operation flag is not a ONE, the controller 80 turns a first-document flag to a ONE, then energizes the pick-up SOL 73 and pawl cancel SOL 75, then loads a job counter JOBC with "1" and a timer STTIM for counting clock pulses which appear within the CPU 81 with "0" and turns the document feed signal to a (logical) ZERO, and then returns to the main routine shown in FIG. 6.

Figure 8:
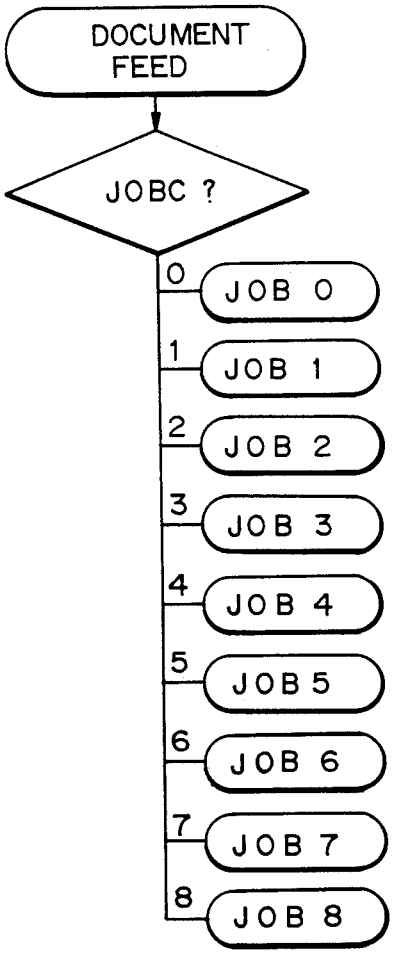
FIG. 8 is a flowchart showing a document feed subroutine also included in the main routine of FIG. 6.

FIG. 8 shows details of the DOCUMENT FEED subroutine of FIG. 6, and FIGS. 9 to 17 show the contents of jobs JOB0 to JOB8 included in the subroutine. After completing the subroutine of FIG. 7, the ADF controller 80 starts on the subroutine of FIG. 8 which begins with checking the content of the job counter JOBC.

Figure 9:
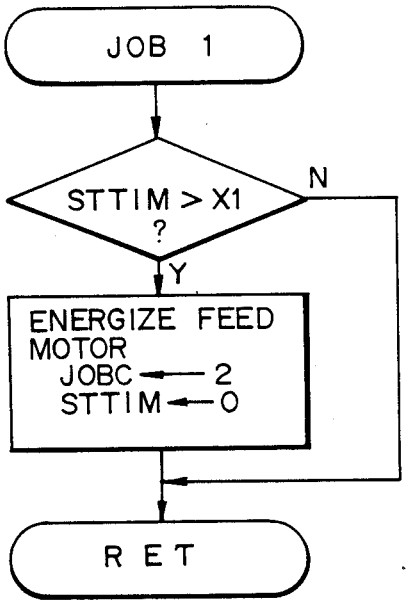
FIGS. 9 to 17 are flowcharts each demonstrating a different job which is included in the subroutine of FIG. 8.
Figure 10:
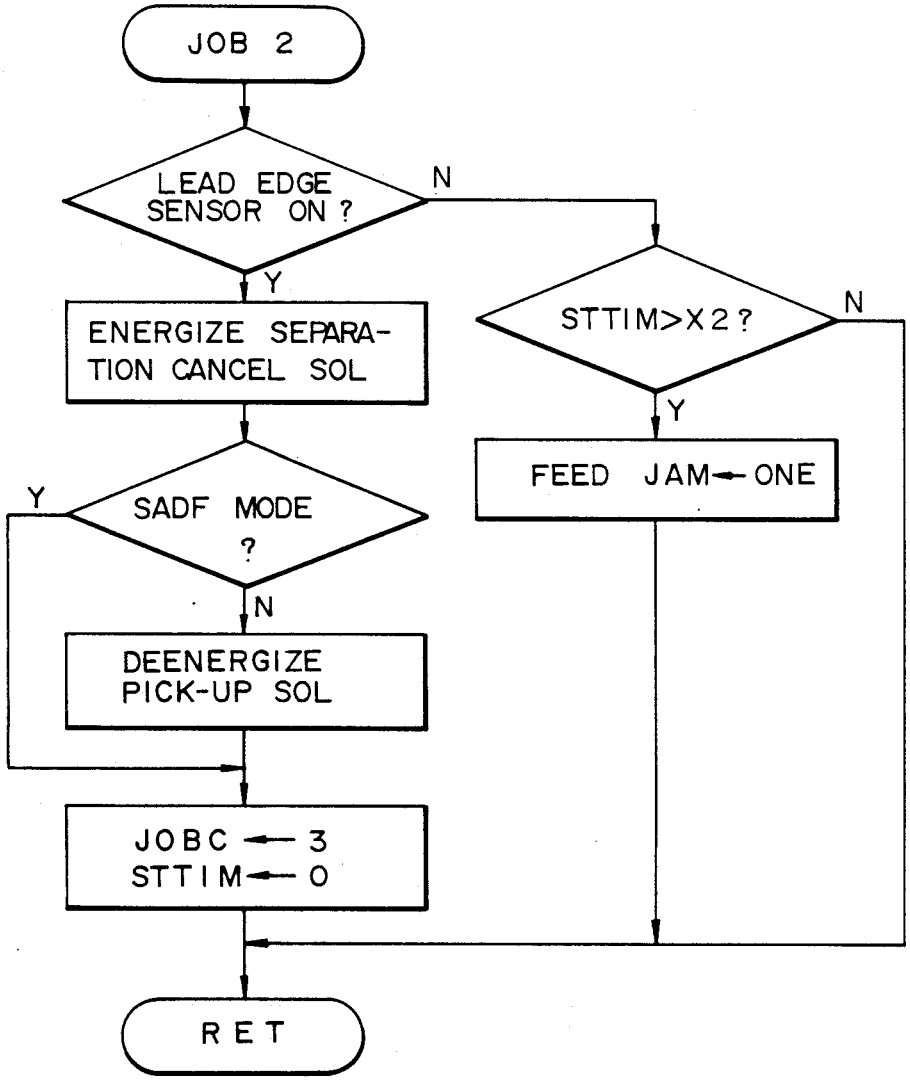

Since the job counter JOBC is "1" at first, the program is transferred to JOB1 shown in FIG. 9. As shown, the controller 80 compares the timer STTIM with a predetermined value "X1" and, if the former is equal to or smaller than the latter, it returns to the main routine of FIG. 6. If the timer STTIM is greater than X1, the controller 80 turns on the feed motor 70, increments the job counter JOBC to "2", and resets the timer STTIM to "0" and, then, returns to the main routine of FIG. 6. As the job counter JOBC becomes "2", the program is transferred to JOB2 shown in FIG. 10. In JOB2, whether the lead edge sensor 59 is in an ON state is determined and, if the answer is YES, the separation cancel SOL 76 is energized. This is followed by determining whether the SADF mode has been selected. If the SADF mode has not been selected, the pick-up SOL 73 is deenergized and, if otherwise, the state of the pick-up SOL 73 is not changed. Then, the job counter JOBC is incremented to "3" and the timer STTIM is reset to "0", the program then returning to the main routine. On the other hand, if the lead edge sensor 59 is in an OFF state, the timer STTIM is compared with another predetermined value "X2". The program directly returns to the main routine of FIG. 6 if the timer STTIM is equal to or smaller than X2 and returns to the same after turning a feed jam flag to a ONE if otherwise.

Figure 11:
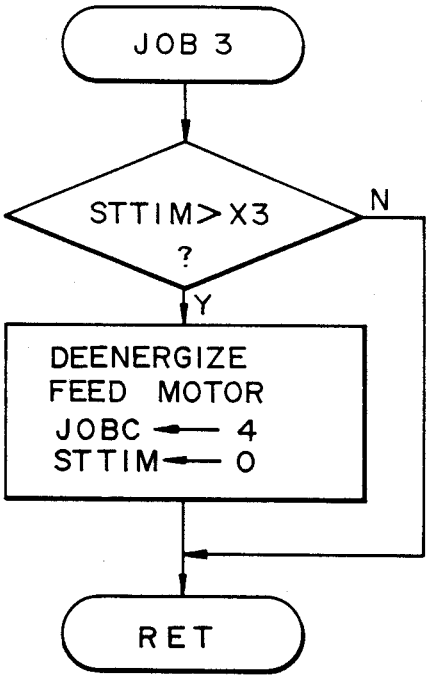
Figure 12:
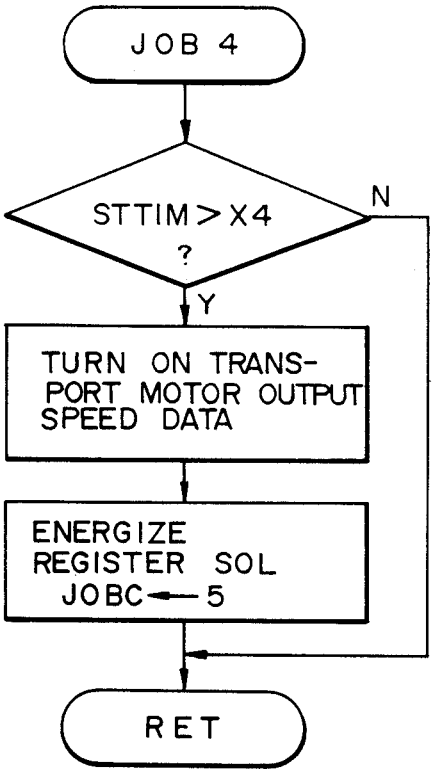

If the job counter JOBC is "3" as determined by the subroutine of FIG. 8, the program is transferred to JOB3 of FIG. 11 which begins with comparing the timer STTIM with another predetermined value "X3". If the timer STTIM is equal to or smaller than 3, the program directly returns to the main routine of FIG. 6. If otherwise, the program returns to the main routine after deenergizing the feed motor 70, incrementing the job counter JOBC to "4", and loading the timer STTIM with "0". As the job counter JOBC is incremented to "4", the program is transferred to JOB4 shown in FIG. 12. In JOB4, the ADF controller 80 compares the timer STTIM with a predetermined value "X4" and, if the former is equal to or smaller than X4, the program directly returns to the main routine of FIG. 6. If the timer STTIM is greater than X4, the controller 80 energizes the transport motor 71 while delivering speed data associated with the transport speed of the document to the servo controller 84 of FIG. 5, then energizes the register SOL 74 incrementing the job counter JOBC to "5", and then returns to the main routine of FIG. 6.

Figure 13:
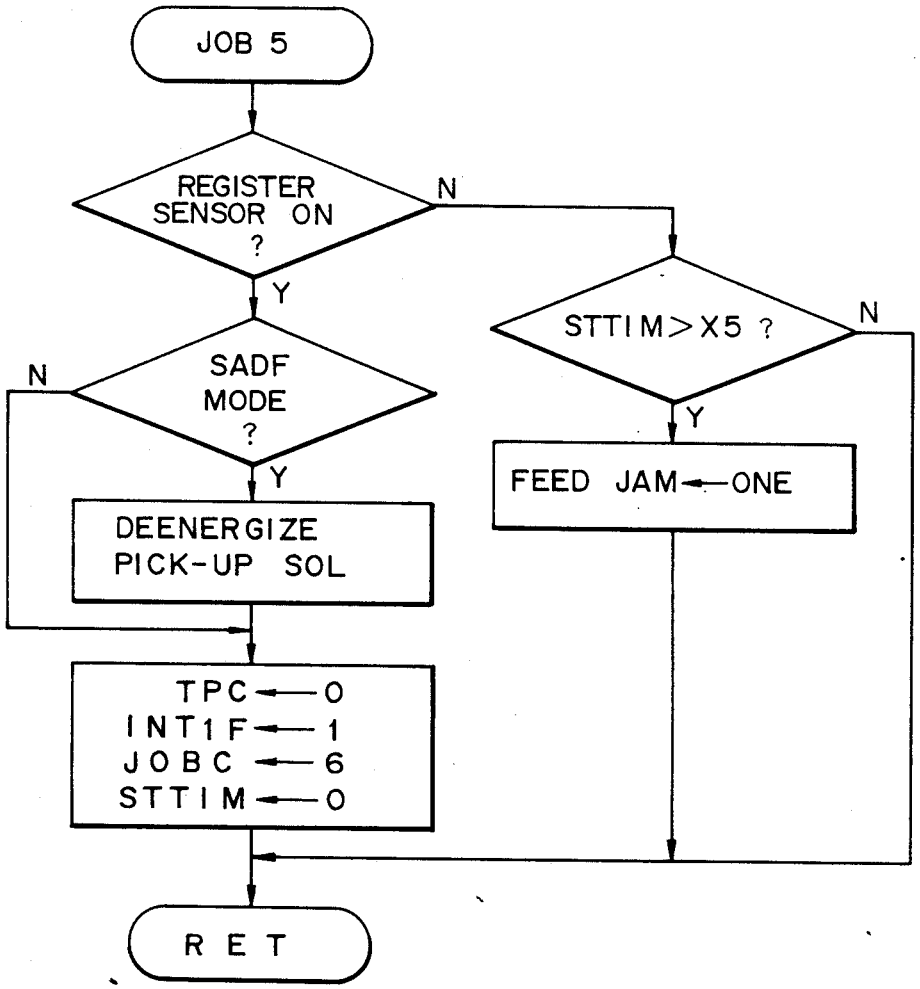

When the job counter JOBC is incremented to "5", JOB5 shown in FIG. 13 is executed. Specifically, whether the register sensor 61 shown in FIG. 4 is in an ON state is determined and, if the answer is YES, whether the SADF mode has been selected is determined. If the SADF mode has been selected, the pick-up SOL 73 is deenergized and the program returns to the main routine of FIG. 6. If the SADF mode has been selected, the pick-up SOL 73 is deenergized and, if it has not been selected, the pick-up SOL 73 is not deenergized. Then, a pulse counter TPC for counting output pulses of the encoder 77 associated with the transport motor 71 is reset to "0", followed by turning an interrupt enable flag INT1F for validating the interrupt terminal INT1 of the CPU 81 of FIG. 5 to a ONE. Further, the job counter JOBC is incremented to "6", the timer STTIM is reset to "0", and the program returns to the main routine of FIG. 6. Conversely, if the register sensor 61 is in an OFF state, the timer STTIM is compared with a predetermined value "X5". Then, the program directly returns to the main routine of FIG. 6 if the timer STTIM is equal to or smaller than X5 and returns to it after turning the feed jam flag to a ONE.

Figure 14:
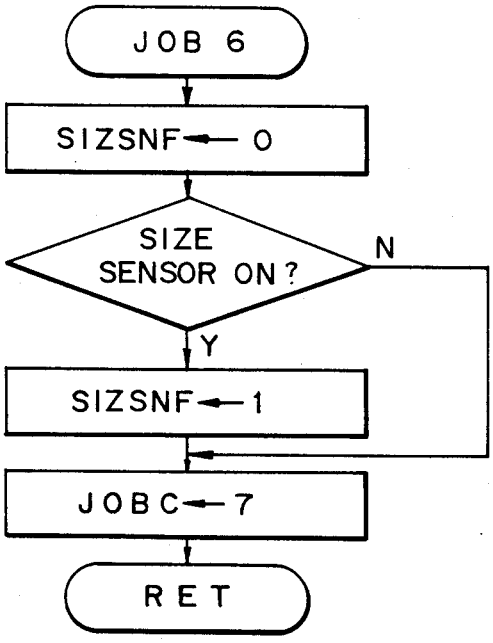
Figure 15:
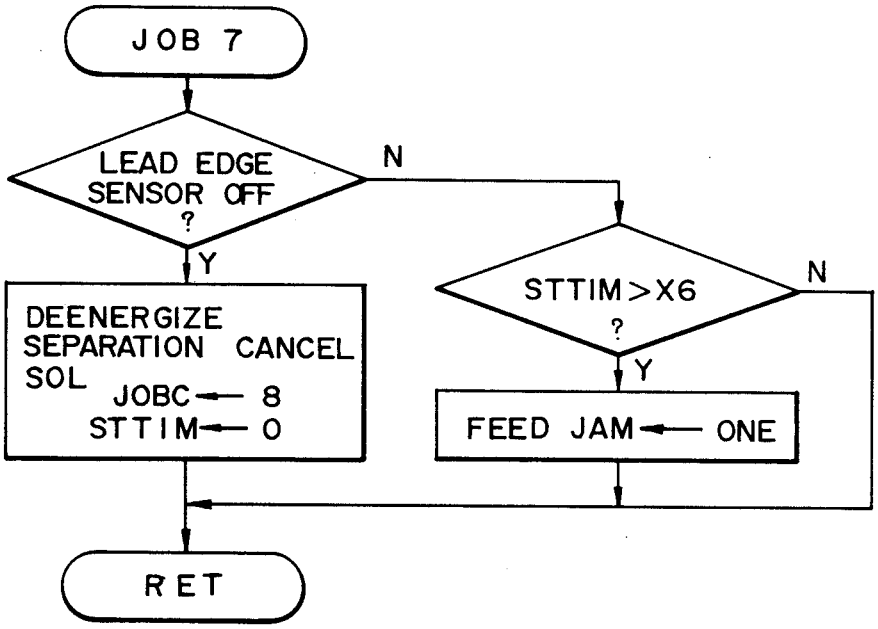

Upon the increment of the job counter JOBC to "6", the program is transferred to JOB6 of FIG. 14. In JOB6, a size sensor flag SIZSNF is reset to a ZERO and then whether the size sensor 60 is in an ON state is determined. If the size sensor 60 is in an ON state, the size sensor flag SIZSNF is set to a ONE. Then, the program returns to the main routine of FIG. 6 after incrementing the job counter JOBC to "7". As the job counter JOBC is incremented to "7", JOB7 shown in FIG. 15 is executed. First, whether the lead edge sensor 59 is in an OFF state is determined and, if it is in an OFF state, the separation cancel SOL 75 is turned off, the job counter JOBC is incremented to "8", and the timer STTIM is reset to "0". If the lead edge sensor 59 is in an ON state, the timer STTIM is compared with a predetermined value "X6". Then, the program directly returns to the main routine of FIG. 6 if the timer STTIM is equal to or smaller than X6 and returns to it after turning the feed jam flag to a ONE if otherwise.

Figure 16:
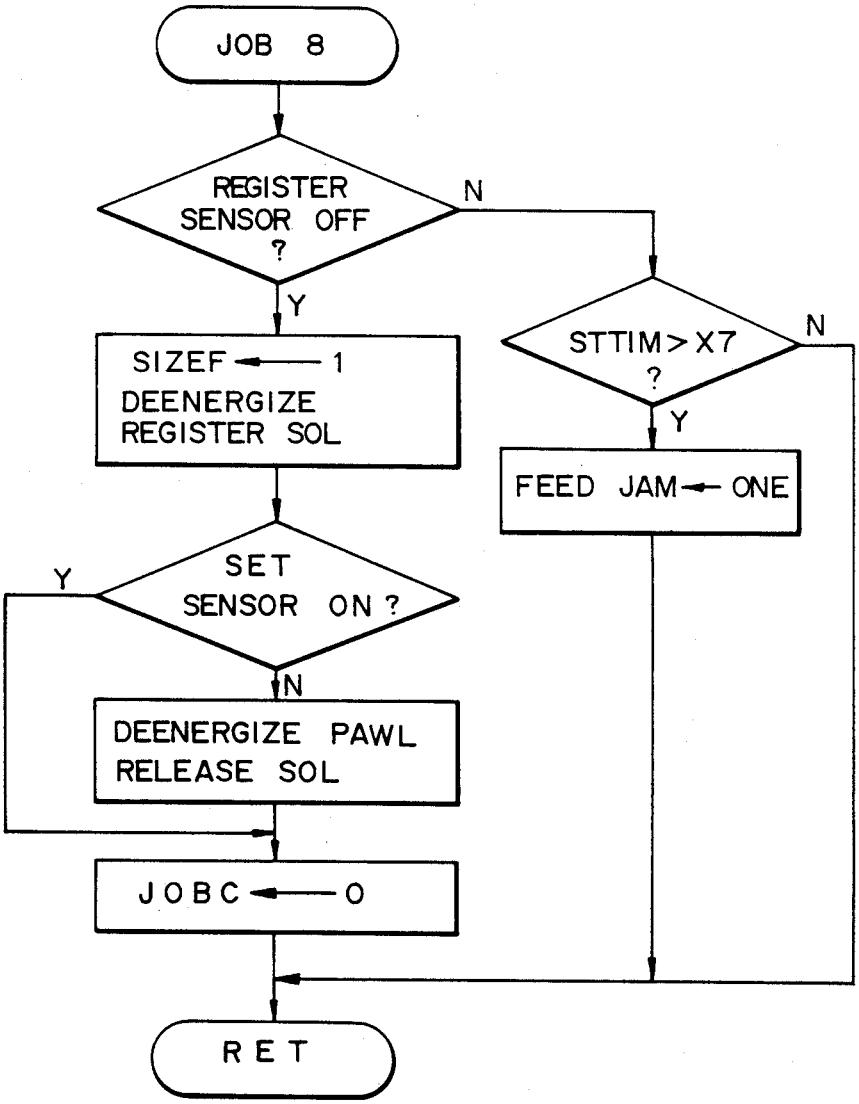
Figure 17:
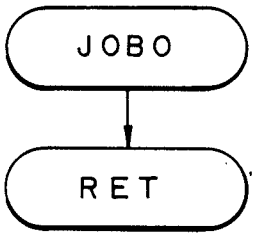

Upon the increment of the job counter JOBC to "8", the operation advances to JOB8 shown in FIG. 16. JOB8 begins with determining whether the register sensor 61 is in an OFF state and, if the answer is YES, turning the size check flag SIZEF to a ONE and deenergizing the register SOL 74. This is followed by determining whether the set sensor 52 is in an ON state. If the answer is NO, the pawl release solenoid SOL 75 is deenergized. Then, the program returns to the main routine of FIG. 6 after resetting the job counter JOBC to "0". On the other hand, if the register sensor 61 is in an ON state, the timer STTIM is compared with a predetermined value "X7" and, if the former is is equal to or smaller than the latter, the program directly returns to the main routine of FIG. 6. If the timer STTIM is greater than X7, the program returns to the main routine after setting the feed jam flag to a ONE. When the job counter JOBC is reset to "0", JOB0 shown in FIG. 17 is executed, i.e., the program returns to the main routine of FIG. 6 for completing all of the various subroutines associated with document feed.

Figure 18:
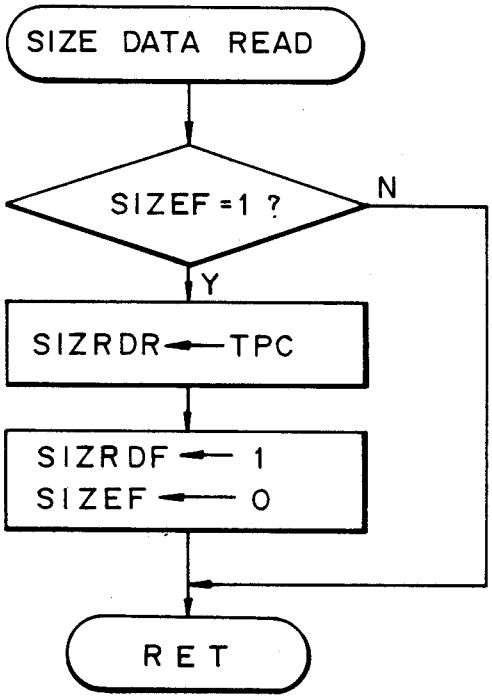
FIG. 18 is a flowchart representative of a size date read subroutine of FIG. 6.

FIG. 18 shows the contents of SIZE DATA READ subroutine shown in FIG. 6. As shown, upon completion of the subroutines associated with document feed, whether the size check flag SIZEF is a ONE is determined. If it is a ONE, the instantaneous count of the pulse counter TPC (associated with the length of a document in the direction feed, i.e., size data) is stored in a size read register SIZRDR. This is followed by setting a size read flag SIZRDF to a ONE, resetting the size check flag SIZEF to a ZERO, and returning to the main routine of FIG. 6. If the size check flag SIZEF is not a ONE, the operation returns to the main routine by completing this subroutine.

Figures 19, 19A:
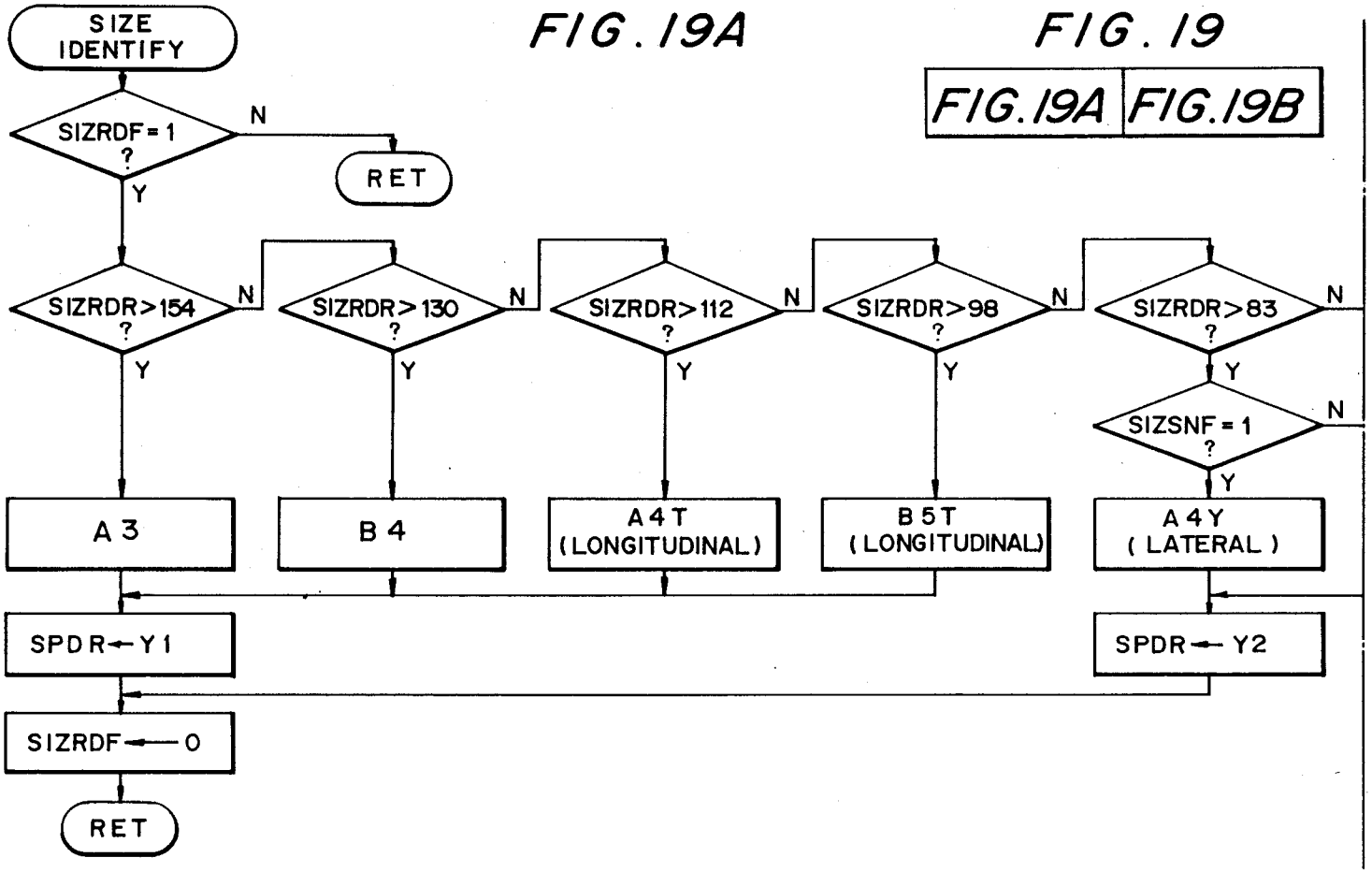
FIG. 19 is a flowchart showing a size identify subroutine of FIG. 6.
Figure 19B:
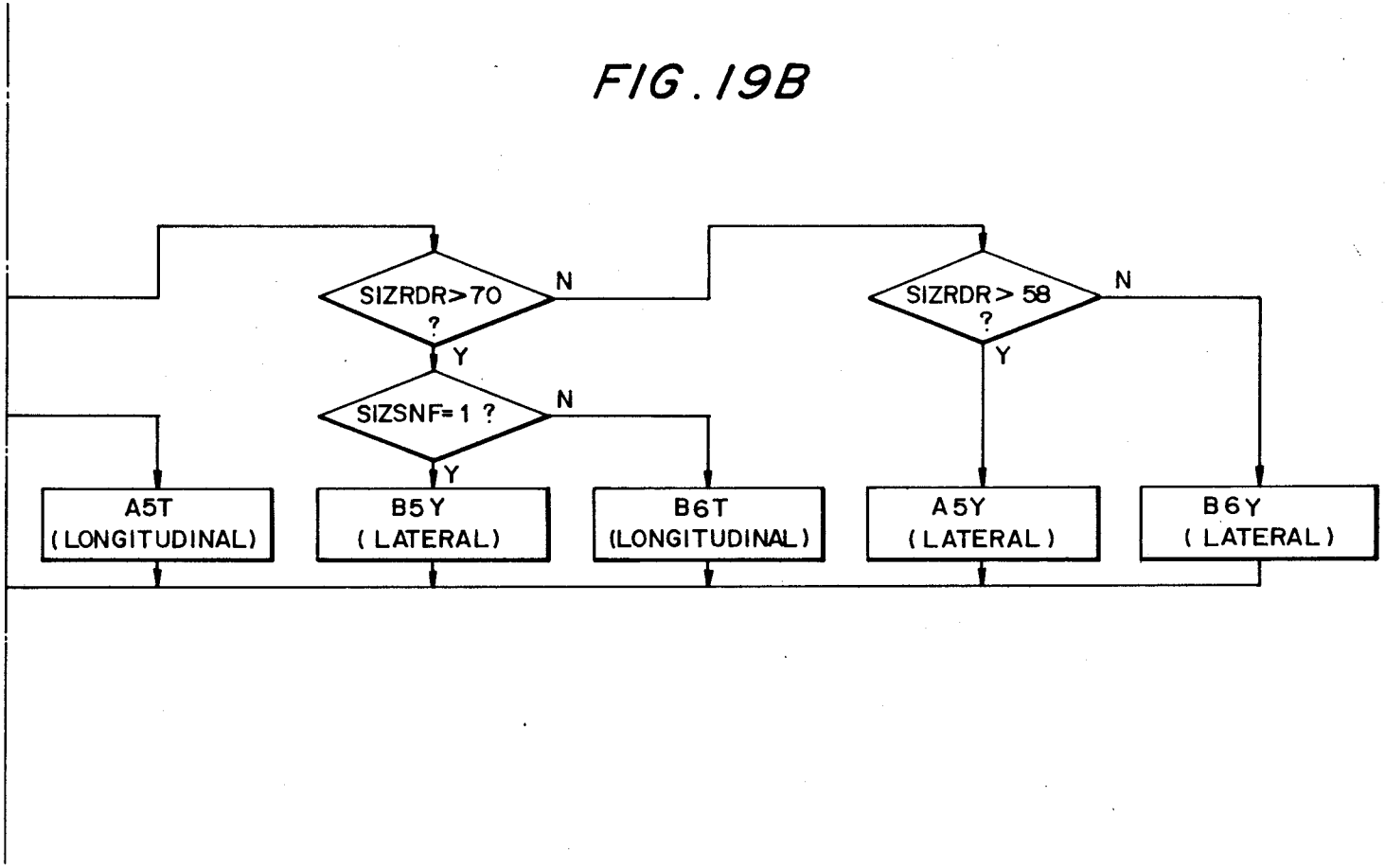

FIG. 19 shows the SIZE IDENTIFY subroutine of FIG. 6 which follows the SIZE DATA READ subroutine. As shown, whether the size read flag SIZRDF is a ONE is determined and, if it is not a ONE, this routine is ended and the program returns to the main routine of FIG. 6. If the flag SIZRDF is a ONE, the data (count data) stored in the size read register SIZRDR is sequentially compared with "154", "130", "112", "98", "83", "70" and "58" to determine the size of the document. Specifically, if the count data stored in the register SIZRDR is greater than "154", the document size is determined to be A3; if the count data is smaller than "154" and greater than "130", the document size is determined to be B4; if the count data is smaller than "130" and greater than "112", the document size is determined to be A4T (T being representative of a longitudinally long position); and if the count data is smaller than "112" and greater than "98", the document size is determined to be B5T. Further, if the count data is smaller than "98" and greater than "83", whether the size sensor flag SIZSNF is a ONE is determined and, if the answer is YES, the document size is determined to be A4Y (Y being representative of a laterally long position) and, if is is NO, the document size is determined to be A5T. When the count data is smaller than "83" and greater than "70", whether the size sensor flag SIZSNF is a ONE is determined also. If the flag SIZSNF is a ONE, the document size is determined to be B5Y and, if it is a ZERO, the document size is determined to be B6T. When the count data is smaller than "70" and greater than "58", the document size is determined to be A5Y and, when the count data is smaller than "58", the document size is determined to be 6Y.

When any of the formats A3, B4, A4T and B5T is identified, feed amount data "Y1" is loaded in a stop position data register SPDR for stopping the leading edge of the second document and the successive documents at the first stop position b shown in FIG. 2. When any of the formats A4Y, A5T, B5Y, B6T, A5Y and B6Y is identified, feed amount data "Y2" is loaded in the register SPDR for stopping the leading edge of the second document and onward at the second stop position d shown in FIG. 2. Thereafter, the size read flag SIZRDF is reset to a ZERO and, then, the program returns to the main routine of FIG. 6.

Figure 20:
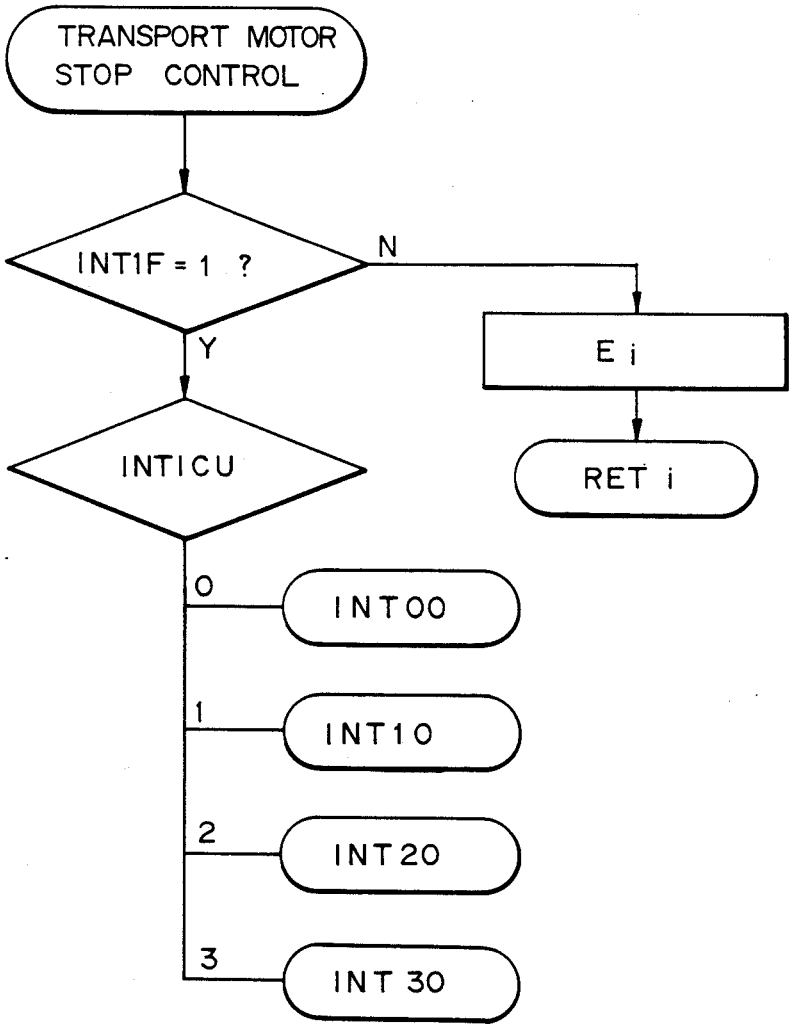
FIG. 20 is a flowchart demonstrating a specific procedure for motor control which is effected by interrupt processing.
Figure 21:
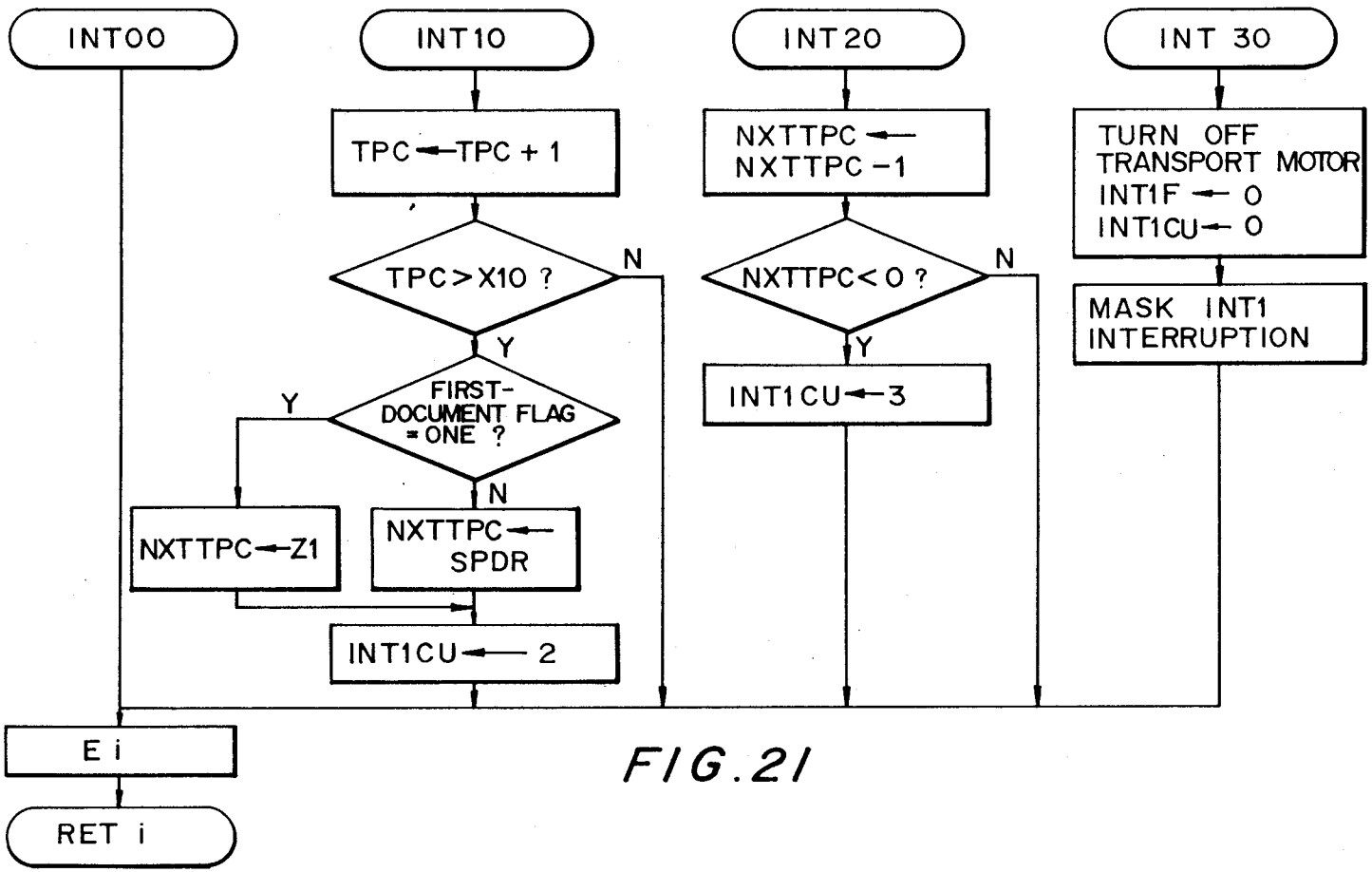
FIG. 21 is a flowchart representative of various interrupt jobs which are shown in FIG. 20.

A reference will be made to FIGS. 20 and 21 for describing the transport motor stop control adapted to set a document at a predetermined position. First, in the routine shown in FIG. 20, whether the interrupt enable flag INT1F is a ONE is determined and, if the answer is YES, the content of an interrupt job counter INT1CU is checked to execute any of the subroutines shown in FIG. 21 depending upon the content of the counter INT1CU. Specifically, if the flag INT1F is a ZERO, no interrupt processing will occur and, therefore, a job being executed is continued by returning to the associated routine. If the interrupt job counter INT1CU is a ONE, a subroutine labeled INT10 in FIG. 21 is executed. The subroutin INT10 begins with adding "1" to the count of the pulse counter TPC, then determining whether the resulting count of the counter TPC is greater than a predetermined amount of feed "X10", and, if the answer is YES, determining whether the first-document flag is a ONE.

If the first-document flag is a ONE (indicating that the first document is to be fed), a second pulse counter NXTTPC is loaded with data "Z1" for transporting a document to the first stop position b shown in FIG. 2, then the interrupt job counter INT1CU is incremented to "2", and then the program returns to another subroutine being under way. If the first-document flag is not a ONE, the second pulse counter NTTPC is loaded with the data "Y1" or "Y2" stored in the stop position register SPDR (see FIG. 19), then the read job counter INT1CU is incremented to "2", and then the program returns to another routine being under way.

Upon the increment of the interrupt job counter INT-1CU to "2", a subroutine labeled INT20 in FIG. 21 is executed. In this subroutine, the second pulse counter NTTPC is decremented by "1", then whether the resulting count is negative (NXTTPC <0) is determined, then if the answer is YES, the interrupt job counter INT1CU is incremented to "3", and then the program returns to another subroutine being under way. As the interrupt job counter INT1CU becomes "3", a subroutine INT30 shown in FIG. 21 is executed. In the INT30 subroutine, the transport motor 71 is deenergized, the interrupt job counter INT1CU is reset to "0", the interrupt terminal INT 1 shown in FIG. 5 is masked to inhibit interruption, and the program returns to another subroutine being executed. When the interrupt job counter INT1CU becomes "0", a subroutine INT00 shown in FIG. 21 is executed, i.e., another subroutine being under way is resumed and all the subroutines associated with transport motor control are completed.

As stated above, by changing the document stop position on the glass platen depending upon the document size, it is possible to noticeably reduce the period of time necessary for a document whose size is smaller than A4 (laterally long) to be brought to a position for exposure by the ADF and, therefore, to promote faster continuous copying. Further, when the size of a document as measured in the direction of feed by the ADF is actually sensed to change the document stop position as mentioned above and, in addition, the resulting size information is fed to the control section of the copier body to change the home position of the scanner, the copying efficiency can be increased with ease even in a magnification change (enlarge or reduce) copy mode in which the document size and the paper size for reproduction are different from each other.

While the illustrative embodiment has been described as defining two document stop positions b and d on the glass platen 11 of FIG. 2 and two home positions a and c which are respectively associated with the positions b and d, three or more document stop positions and three or more home positions may be adopted in association with the various sizes of documents. This may be implemented by increasing the number of home position switches and modifying the control software accordingly. The home position switches can be omitted if an arrangement is so made as to generate pulses continuously in response to the movement of the scanner and to control the scanner on the basis of the number of the pulses.

Another embodiment of the present invention which is advantageously applicable to a copier without a magnification changing capability will be described with reference to FIGS. 22 to 24. In this alternative embodiment the copier body and the mechanical arrangement and control section of the ADF are generally identical with those shown in FIGS. 2 to 5 with respect to hardware and, therefore, redundant description thereof will be omitted.

A copier without a magnification changing capability performs a ×1 copying operation without exception and, therefore, the size of paper sheets selected is usually the same as the size of documents. It follows that the size of documents can also be determined on the basis of paper size data associated with the cassettes and tray fed from the paper feed section 7 of FIG. 2 and paper selection data entered on the operation board, i.e., without the need for sensing the size of documents. In this particular embodiment, therefore, the control section of the copier body 4 changes the home position of the scanner (first scanner 8 in FIG. 2) in matching relation to the size of paper sheets selected while delivering the paper size data to the ADF controller 80 of the ADF 5 to allow the document stop position on the glass platen 11 to be changed.

When the size of paper sheets selected is larger than A4 (laterally long), a document is stopped when its leading edge reaches the first reference position b shown in FIG. 2 while, at the same time, the first scanner 8 is caused to start scanning the document at the first home position a where the home position switch SW1 is to be turned on. On the other hand, when the paper size selected is smaller than A4 (laterally long), the document is stopped when its leading edge reaches the reference position d shown in FIG. 2 while, at the same time, the first scanner 8 is caused to begin scanning the document at the second home position c where the home position switch SW2 will be turned on.

The feelers serving as means for sensing the sizes of paper sheets which are stacked in the paper cassettes 7A and 7B and mass paper tray 7C are only illustrative and not restrictive. Other possible implementations for sensing such paper sizes may be the combination of size sensing plates individually mounted on the cassettes and tray and photosensors mounted on the copier body 4 and each being associated with a respective one of the sensing plates, or photosensors or magnetic sensor capable of reading printed codes or magnetic codes.

Figures 22, 22A:
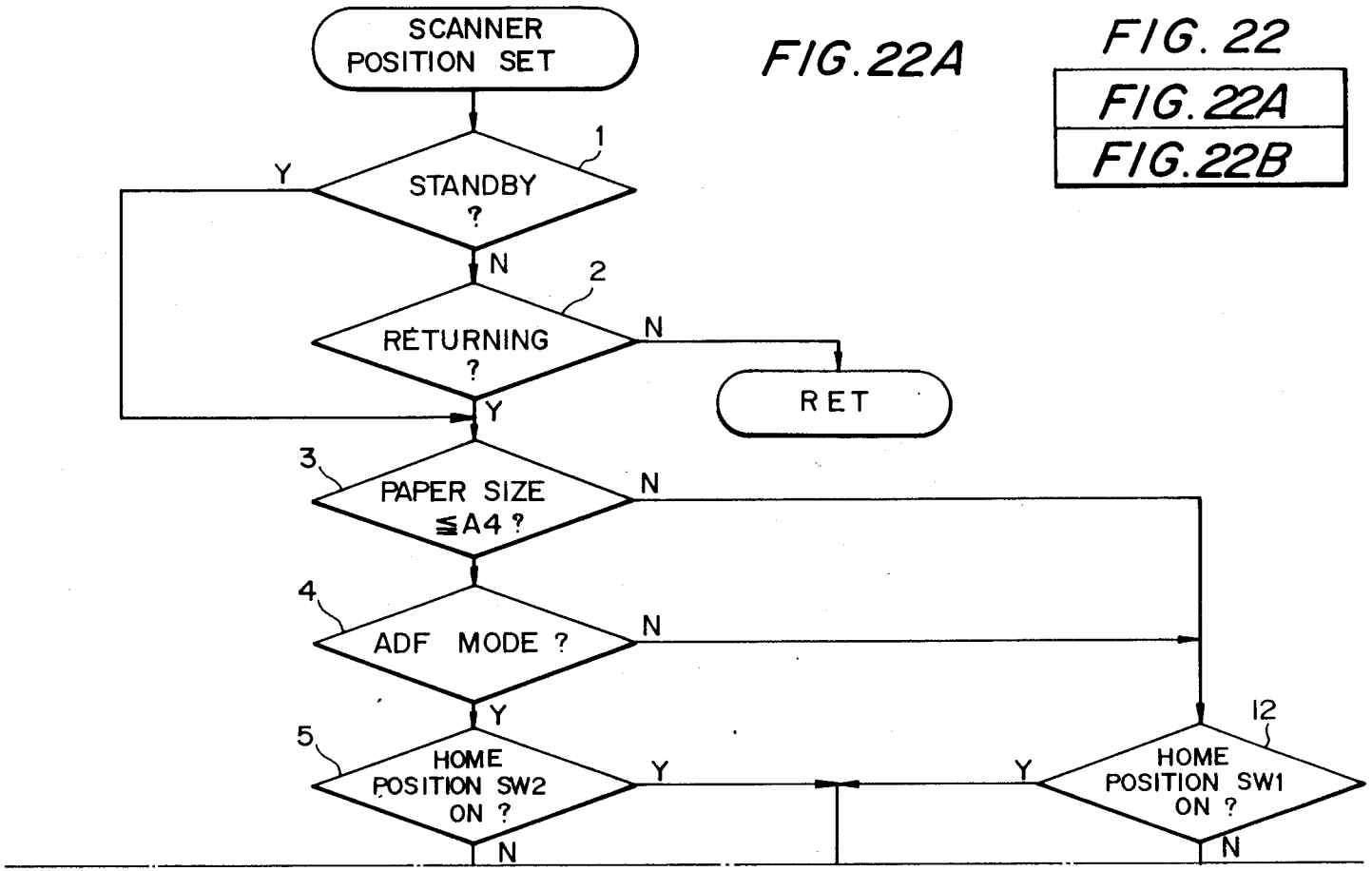
FIG. 22 is a flowchart showing scanner home position change processing executed by a control section in accordance with another embodiment of the present invention.
Figure 22B:
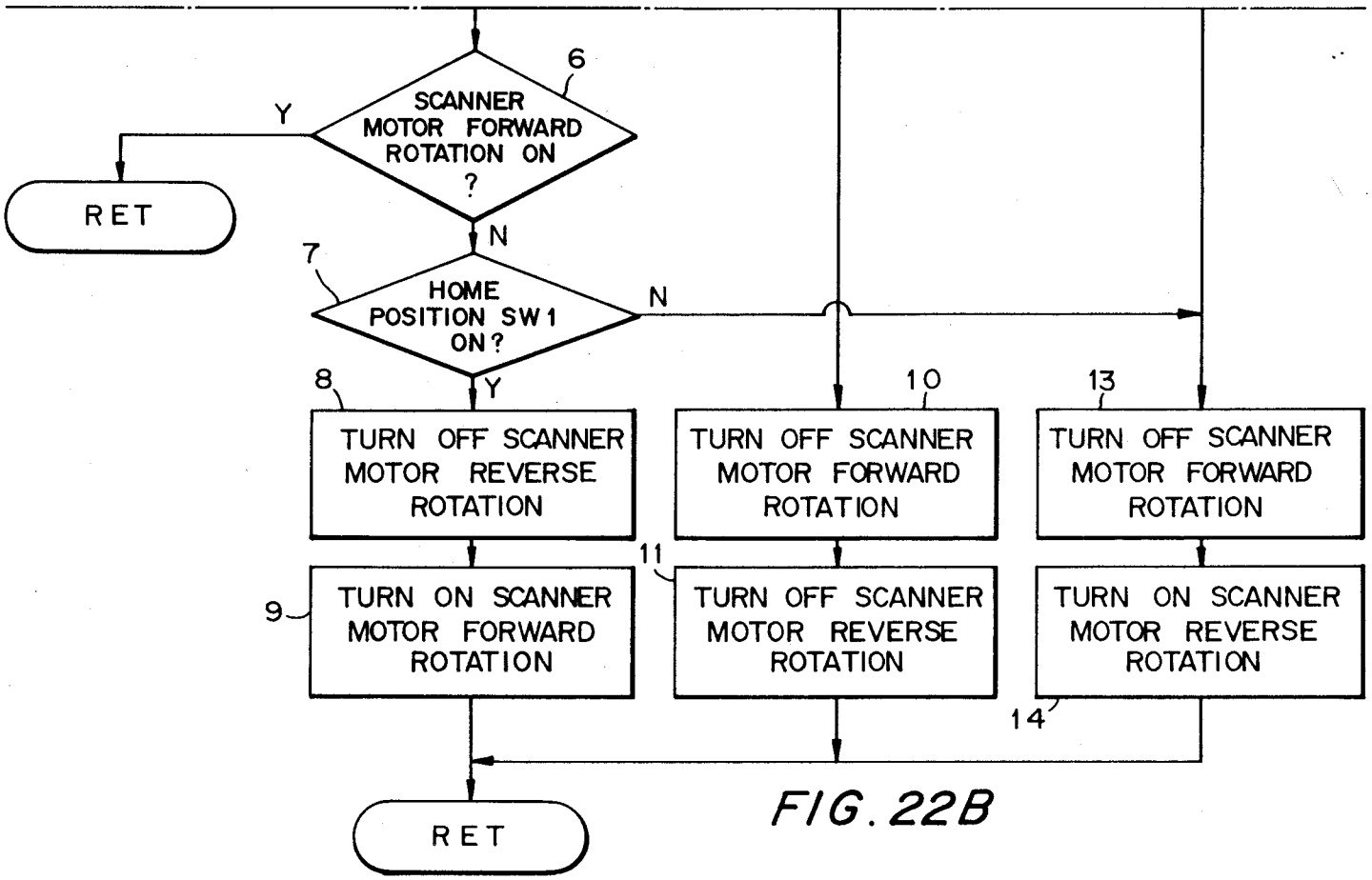

FIG. 22 is a flowchart demonstrating how the control section installed in the copier body of this embodiment locates the scanner in any of the home positions depending upon the paper size selected. In a step 1, whether the scanner is in the standby condition is determined and, if the answer is NO, whether the scanner is returning (after illumination) is determined (step 2). If the scanner is returning, the program returns to a main routine, not shown. If the scanner is in the standby condition or if it is not in the standby position and is not returning, the operation advances to a step 3 to see if the paper size selected is smaller than A4.

If the paper size selected is smaller than A4, a step 4 is executed to see if the ADF mode has been selected. When the paper size is smaller than A4 and the ADF mode has been selected, the program advances to a step 5 for determining whether the home position switch SW2 is in an ON state and, if it is not in an ON state, a step 6 is executed to see if the scanner motor is rotating in the forward direction. If the rotation of the scanner motor is forward, the program returns to the main routine and, if otherwise, the operation advances to a step 7 to see if the home position switch SW1 (see FIG. 2) is in an ON state. If the answer is YES, the reverse rotation of the scanner motor is turned off in a step 8 while the forward rotation of the same is turned on in a step 9. This causes the scanner to move until the home position switch SW2 becomes ON.

Upon the turn of the home position switch SW2 from OFF to ON, the program is transferred from the step 5 to steps 10 and 11 for turning off the reverse rotation of the scanner motor, whereby the scanner is stopped at the second home position. Hence, in the event of illumination, the scanner begins scanning a document at the second home position. When the home position switch SW1 is OFF as decided by the step 7, the program is transferred to steps 13 and 14 for causing the scanner motor to rotate in the reverse direction. Further, when the home position switch SW2 is ON as decided by the step 5, meaning that the scanner is held in the second home position, the steps 10 and 11 are executed to fully stop the rotation of the scanner motor.

If the paper size selected is greater than A4 as determined by the step 3, the operation advances to a step 12 to see if the home position switch SW1 is ON. If the answer is YES, meaning that the scanner is in the first home position, the steps 10 and 11 are sequentially executed to stop the rotation of the scanner motor. If the home position switch SW1 is not ON, steps 13 and 14 are sequentially executed for reversing the rotation of the scanner motor until the scanner is brought to a position where it turns the home position switch SW1 to an ON state. When the ADF mode has not been selected as decided by the step 4, the scanner is brought to a position where it turns the home position switch SW1 to an ON state so that it may always start moving at the first home position.

To summarize, when paper sheets the size of which is smaller than A4 are selected, the scanner 8 located at the first home position a is moved in the direction A shown in FIG. 2 by the reverse rotation of the scanner motor and then stopped as soon as it turns ON the home position switch SW2. Conversely, when the ADF mode is cancelled or when paper sheets the size of which is equal to or larger than A4 are selected, the scanner 8 is shifted in the opposite direction to the first home position a where it turns ON the home position switch SW1.

A reference will be made to FIGS. 23 and 24 for describing the operation of the ADF in accordance with this particular embodiment.

Figure 23:
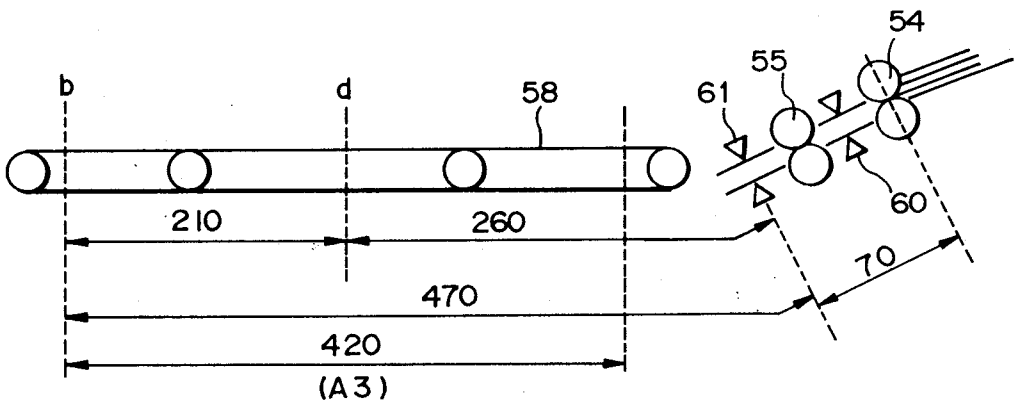
FIG. 23 is a schematic diagram useful for understanding a positional relationship between a belt of an ADF and a first reference position, second reference position and other positions as defined in the embodiment of FIG. 22.

FIG. 23 shows a positional relationship between the belt 58 of the ADF 5 and the first and second reference positions b and d, etc. The distance between the register sensor 61 and the second reference position d corresponds to 260 PLF (number of drive pulses) in terms of a pulse motor while the distance between the first and second reference positions b and d corresponds to 210 PLF. The distance corresponding to 210 PLF is selected to equal the width of an A4 document (i.e. length in the direction of transport when the document is transported in a laterally long position).

Figure 24:
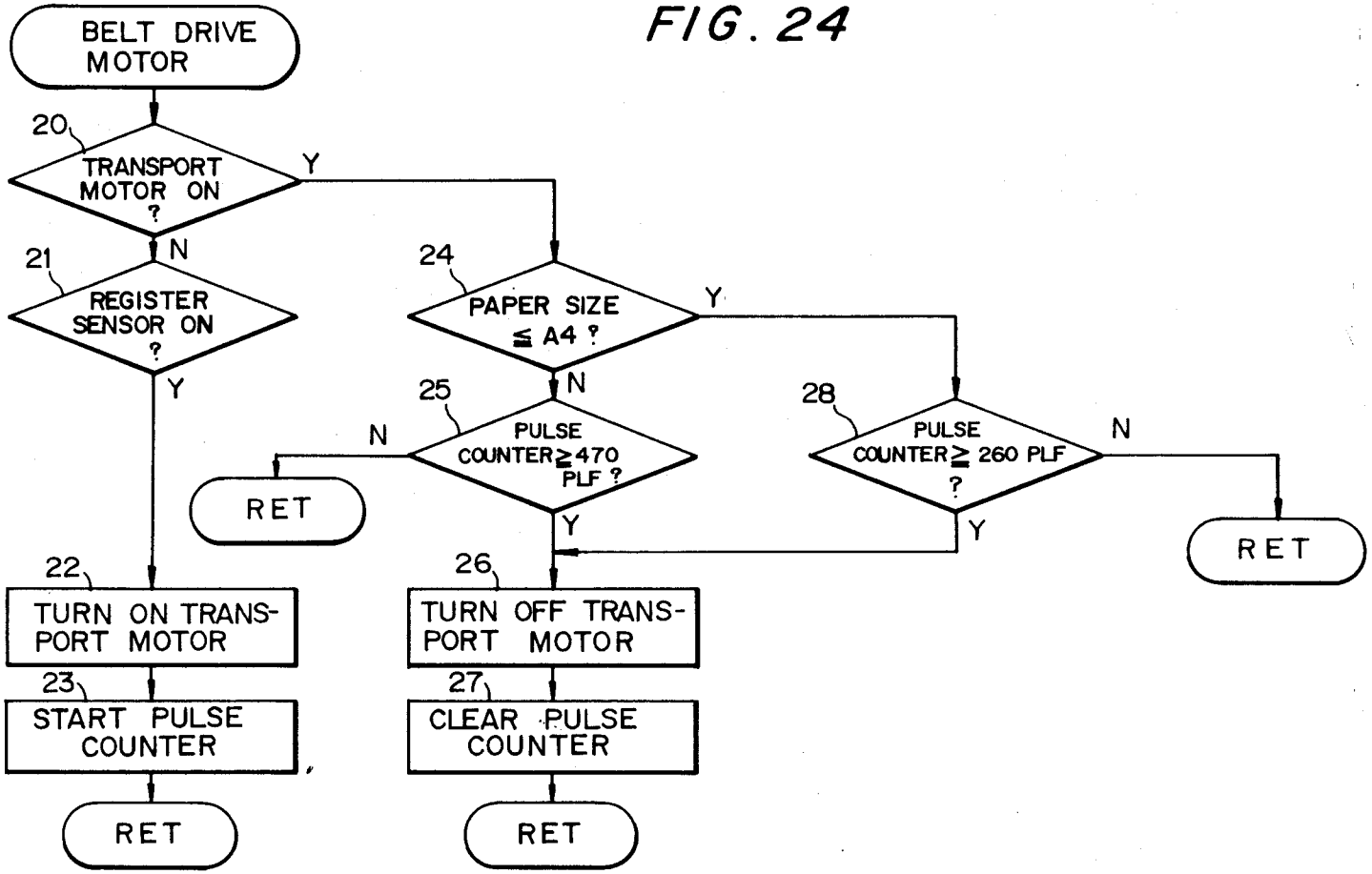
FIG. 24 is a flowchart demonstrating a motor control procedure executed by the ADF controller.

FIG. 24 is a flowchart showing how the transport motor 71 (see FIG. 5) for driving the belt 58 is controlled. As shown, whether the motor 71 is ON is determined in a step 20 and, if it is ON, the program is transferred to a step 21 and, if otherwise, a step 24 is executed. In the step 21, whether the register sensor 61 is ON is determined. When the register sensor 61 becomes ON, the transport motor 71 is energized in a step 22 and a pulse counter is started at a step 23. In the step 24, whether the paper size indicated by paper size data from the copier body 4 is smaller than A4 is determined. If the paper size selected is larger than A4 (laterally long), the program is transferred to a step 25. When the pulse counter counts 470 PLF, i.e., the number of pulses necessary for the motor 71 to transport a document to the first reference position b shown in FIG. 23, a step 26 is executed for deenergizing the motor 71 and followed by a step 27 for clearing the pulse counter. When the paper size is smaller than A4, the operation advances to a step 28. Then, when the pulse counter counts 260 PLF, i.e., the number of pulses necessary for the motor 71 to transport a document to the second reference position d shown in FIG. 23, a step 26 is executed for deenergizing the motor 71 and followed by a step 27 for clearing the pulse counter.

As shown in FIG. 23, assuming that 1 PLF effects 1 millimeter of transport, the distance between a document feed start position defined by the separator roller pair 54 and the second reference position d is produced as 70+260=330 millimeters (on condition that the distance between the roller pair 54 and the register senso 61 is 70 millimeters) while the distance between the document feed start position and the first reference position b is produced as 70+260+210=540 millimeters. Hence, the distance to the second reference position d is shorter by 40% than the distance to the first reference position b. Assuming that the document transport speed is 500 millimeters per second, the document transport time is 1.08 seconds and 0.66 seconds for an A3 document and an A4 document, respectively. Assume that the copying rate available with a copier body alone in a repeat mode is 45 CPM (copies per minute) for format A4. Heretofore, an ADF cannot be used with the copier body without adding the same document setting time as with an A3 document, resulting in a decrease in the copying rate to 25 CPM. In accordance with this embodiment, the copying rate can be increased up to 30 CPM (an increment of 20%) for documents the size of which is smaller than A4.

As stated in relation to the first embodiment, three or more document stop positions and three or more scanner home positions may of course be adopted in association with the sizes of paper sheets for the purpose of promoting much faster copying operations.

In summary, it will be seen that the present invention provides a copier with an ADF which is successful in reducing the period of time necessary for documents of comparatively small sizes to be located on a glass platen, thereby realizing an unprecedented high copying efficiently.

Various modifications will become possible for those skilled in the art after receiving the teachings of the present disclosure without departing from the scope thereof.

What is claimed is:

1. A copier equipped with an automatic document feeder (ADF) which causes said ADF to automatically transport a document to a glass platen and stop the document in a predetermined stop position on said glass platen and causes movable optics for exposure to illuminate an image carrying surface of the document, said copier comprising:

size sensing means for sensing a size of at least one of a document to be transported by said ADF and a paper sheet on which the document is to be reproduced;

position setting means for setting the stop position on said glass platen on the basis of the size sensed by said sensing means; and home position changing means for changing a home position of said optics on the basis of the size sensed by said sensing means.

2. A copier as claimed in claim 1, wherein the paper sheet is fed from a paper feed section to an image transfer station in the same direction as an intended direction of document feed.

3. A copier as claimed in claim 1, wherein the stop position comprises a plurality of stop positions each being associated with a respective one of document sizes and where a leading edge of a document is to be stopped.

4. A copier as claimed in claim 3, wherein said copier is capable of copying a document of format A3 at maximum, the plurality of stop positions comprising a first stop position assigned to documents of format A4 to format A3 and a second stop position assigned to documents of formats smaller than A4.

5. A copier as claimed in claim 3, wherein the home position of said optics comprises a plurality of home positions each being associated with a respective one of the stop positions.

6. A copier as claimed in claim 5, wherein said copier is capable of copying a document of format A3 at maximum, the plurality of stop positions comprising a first stop position assigned to documents of format A4 to format A3 and a second stop position assigned to documents of formats smaller than A4, the plurality of home positions comprising a first and a second home position associated with the first stop position and the second stop position, respectively.

7. A copier as claimed in claim 6, further comprising control means for controlling an amount of movement of said optics and an amount of document transport by said ADF in association with the stop position set by said stop position setting means and the home position selected by said home position changing means.

8. A copier as claimed in claim 7, wherein said control means controls said optics such that said optics remains in a standby condition at the first home position whenever said copier is not operated.

9. A copier as claimed in claim 8, wherein said control means further controls said optics such that said optics starts scanning the first document at the first home position and starts scanning the second document and successive documents selectively at the first home position and the second home position in association with the first stop position and the second stop position, respectively.

10. A copier as claimed in claim 9, wherein said control means further controls said optics such that said optics being returned after illuminating the first document is directly moved to and stopped at either the first home position or the second home position where said optics is to start scanning the second document.

11. A copier as claimed in claim 10, wherein said optics is returned to and stopped at the first home position after illuminating the last document.

12. A copier as claimed in claim 7, wherein said control means controls said optics such that said home position changing means continuously generates pulses in response to a movement of said optics, the pulses are counted, and said optics is moved on the basis of a count of the pulses.

13. A copier as claimed in claim 1, wherein said size sensing means comprises pulse counting means for, when a document being transported by said ADF away from a predetermined position, counting pulses from an instant when a leading edge of the document is sensed.

14. A copier as claimed in claim 1, wherein said size sensing means comprises paper size sensors each being associated with a respective one of paper trays which are loaded with paper sheets of different sizes.

15. A copier as claimed in claim 14, wherein said paper size sensors comprise feelers each being responsive to a size of paper sheets.

16. A copier as claimed in claim 1, wherein said home position changing means comprises home position switches each being associated with a respective one of the home positions.

* * * * *